US008419302B2

(12) United States Patent
Watanabe et al.

(10) Patent No.: US 8,419,302 B2
(45) Date of Patent: Apr. 16, 2013

(54) PRINTING APPARATUS

(75) Inventors: Sumio Watanabe, Shinagawa (JP); Fumio Sakurai, Shinagawa (JP); Yukihiro Mori, Shinagawa (JP); Yoshinari Takabatake, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 311 days.

(21) Appl. No.: 11/450,551

(22) Filed: Jun. 12, 2006

(65) Prior Publication Data

US 2006/0291933 A1 Dec. 28, 2006

(30) Foreign Application Priority Data

Jun. 22, 2005 (JP) ..... 2005-182502
Jul. 22, 2005 (JP) ..... 2005-212737

(51) Int. Cl.
*B41J 2/315* (2006.01)
*B41J 25/308* (2006.01)
*B41J 25/316* (2006.01)

(52) U.S. Cl.
USPC ..... 400/120.16; 347/197; 347/220

(58) Field of Classification Search ..... 400/120.16, 400/120.17, 659, 660, 642, 58; 347/197–198
See application file for complete search history.

(56) References Cited

U.S. PATENT DOCUMENTS 5,548,318 A * 8/1996 Ro et al. ..... 347/174
6,336,760 B2 * 1/2002 Mori et al. ..... 400/649
6,626,597 B2 * 9/2003 Fujiwara ..... 400/659
6,682,239 B2 * 1/2004 Mori et al. ..... 400/649
6,688,787 B2 * 2/2004 Arakawa et al. ..... 400/120.16
6,765,602 B2 7/2004 Mori ..... 347/220
7,001,089 B2 * 2/2006 Tozaki et al. ..... 400/708
7,002,611 B2 * 2/2006 Mori et al. ..... 347/215
7,614,809 B2 * 11/2009 Kaiya ..... 400/120.16
2002/0021927 A1 * 2/2002 Mori et al. ..... 400/120.01
2003/0076401 A1 * 4/2003 Mori et al. ..... 347/215
2005/0135858 A1 * 6/2005 Untersteller et al. .... 400/120.16

FOREIGN PATENT DOCUMENTS

JP 6-27424 7/1994
JP 6-94222 11/1994
JP 11-151847 6/1999
JP 2000-94767 4/2000
JP 2000-118060 4/2000
JP 2002-145501 5/2002
JP 2003-200625 7/2003
JP 2004-195805 7/2004
JP 2004-345264 12/2004

OTHER PUBLICATIONS

Japanese Office Action mailed Jul. 27, 2010 issued with respect to corresponding Japanese patent application No. 2005-212737.

* cited by examiner

*Primary Examiner* — Matthew G Marini
*Assistant Examiner* — Marissa Ferguson Samreth
(74) *Attorney, Agent, or Firm* — Staas & Halsey LLP

(57) ABSTRACT

A printing apparatus configured to carry out printing on paper with a printing head, while holding the paper between the printing head and a platen roller, includes: a paper guide block guiding the paper in between the printing head and the platen roller, and holding the platen roller; and a force applying member applying a force to any one of the paper guide block and the printing head in such a manner as to press the any one of the paper guide block and the printing head.

31 Claims, 50 Drawing Sheets

800

PRINTING APPARATUS

BACKGROUND OF THE INVENTION

1. Field of the Invention

The present invention relates to a printing apparatus, and, in particular, to a printing apparatus in which paper is inserted between a printing head and a platen roller and printing to the paper is carried out.

2. Description of the Related Art

A printing apparatus is incorporated in a portable terminal unit such as a POS terminal, a ticket terminal or such, for carrying out printing for a print such as a receipt, a ticket or such (see Japanese Laid-open Patent Application No. 2000-94767).

In the printing apparatus, paper is held between a printing head and a platen roller, and printing is carried out with the printing head to the paper.

At this time, in order to hold the paper between the printing head and the platen roller, the printing head and the platen roller are pressed together with a coil spring or such provided on a surface perpendicular to the printing head and the platen roller. Further, a paper guide is provided for guiding the paper to between the printing head and the platen roller.

SUMMARY OF THE INVENTION

In the printing apparatus in the prior art, since the printing head and the platen roller are pressed together with a coil spring or such provided on a surface perpendicular to the printing head and the platen roller as mentioned above, an extra space is required in a direction in which the printing head and the platen roller are supported, and thus, reduction in the apparatus thickness may become difficult. Further, the number of components increases, and a structure may become complicate accordingly. Therefore, a printing apparatus having a construction such that the structure can be simplified, and also, miniaturization is possible, is required.

The present invention has been devised in consideration of these points, and an object of the present invention is to provide a printing apparatus for which a structure can be simplified, and also, miniaturization is possible.

According to the present invention, in a printing apparatus configured to carry out printing on paper with a printing head while holding the paper between the printing head and a platen roller, a paper guide block guiding the paper in between the printing head and the platen roller and holding the platen roller; and a force applying member applying a force to any one of the paper guide block and the printing head in such a manner as to press any one of the paper guide block and the printing head, are provided.

In this configuration, the force applying member applies a force to the paper guide block which guides the paper to between the printing head and the platen roller and also holds the platen roller and the paper or to the printing head so that the paper guide block or the printing head is pressed to one another, and thus, a part which rotatably supports the platen roller and the printing head can be integrally provided. As a result, it is possible to reduce the number of components, and thus, it is possible to simplify the structure and achieve miniaturization.

BRIEF DESCRIPTION OF THE DRAWINGS

Other objects and further features of the present invention will become more apparent from the following detailed description when read in conjunction with the accompanying drawings.

DETAILED DESCRIPTION OF THE PREFERRED EMBODIMENTS

Figure 1:
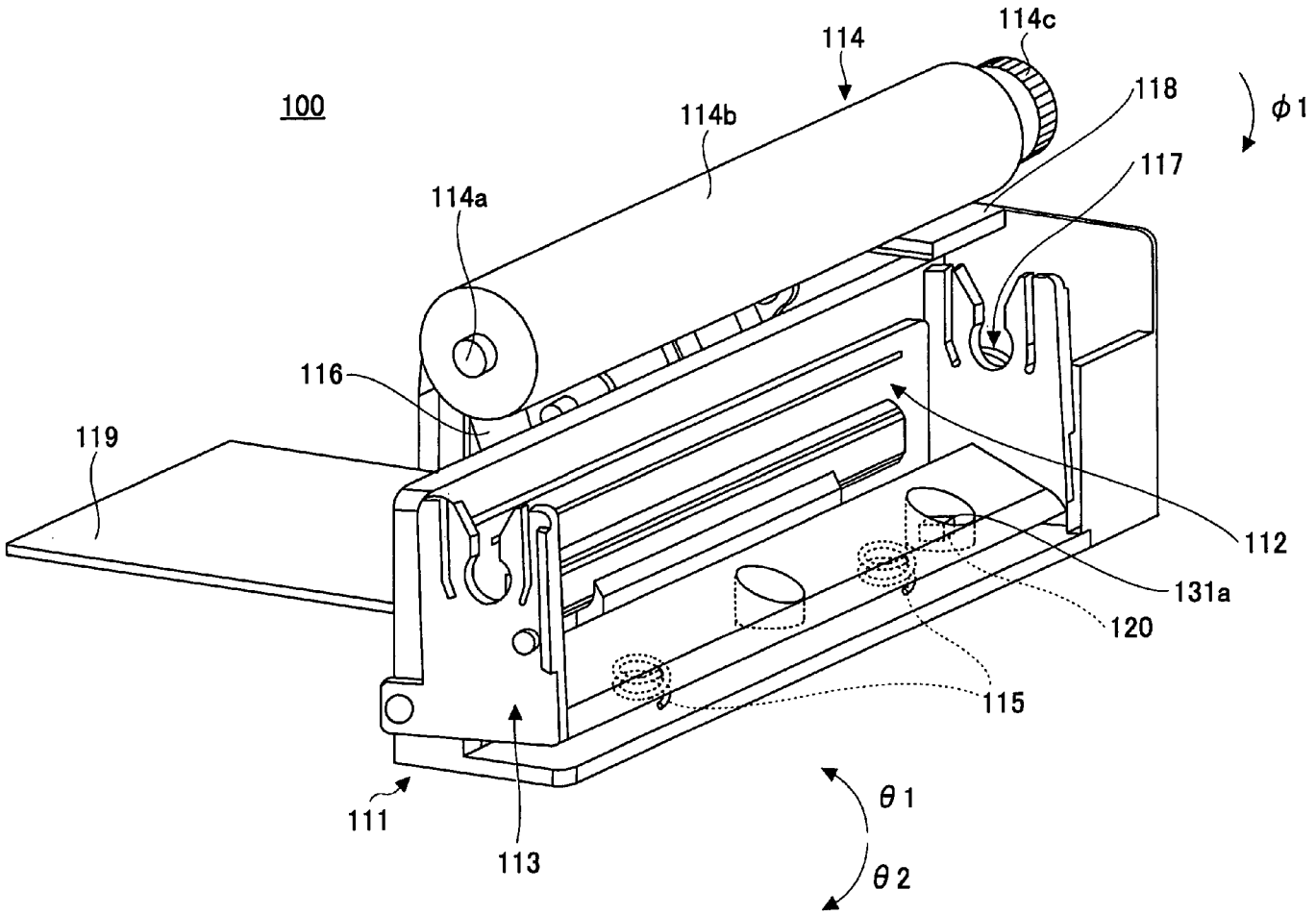
FIG. 1 shows a perspective view of a first embodiment of the present invention.

FIG. 1 shows a perspective view of a first embodiment of the present invention.

A printing apparatus 100 in the first embodiment includes a frame 111, a printing head 112, a paper guide block 113, a platen roller 114, coil springs 115, a motor 116, a reduction gear mechanism 117, a gear cover 118, a flexible printed wiring cable 119 and a sensor 120.

[Frame]

Figure 2:
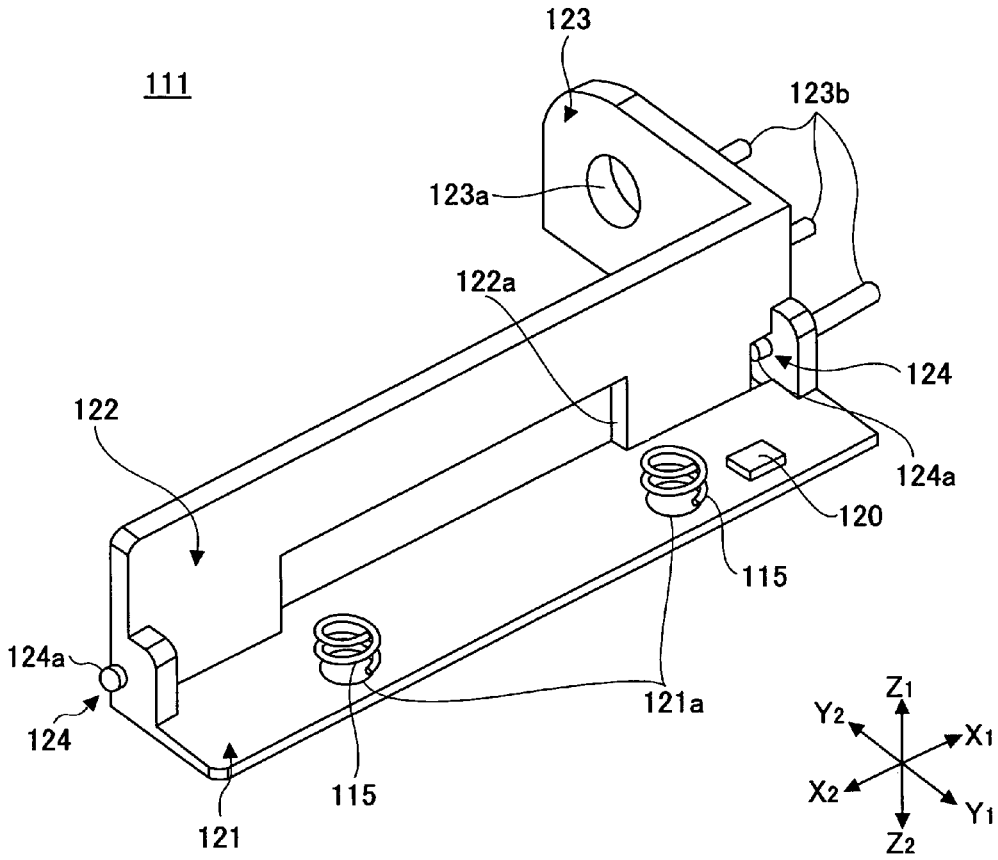
FIG. 2 shows a perspective view of a frame 111.

FIG. 2 shows a perspective view of the frame 111.

The frame 111 is made of an electrically conducive member such as metal, and includes a base part 121, a head holding part 122, a driving mechanism holding part 123 and paper guide block holding parts 124, which are integrally formed.

The base part 121 faces a bottom surface of the paper guide block 113, and has coil spring holding parts 121*a* provided for holding the coil springs 115 on a surface facing the bottom surface of the paper guide block 113, i.e., the surface in an arrow Z1 direction side. Further, a sensor 120 is mounted on the base part 121.

The head holding part 122 has a printing head 112 disposed on a front surface side, i.e., the side of an arrow Y1, and, on a rear surface side, i.e., the side of an arrow Y2 of the head holding part 122, the flexible printed wiring cable 119 is disposed, which provides data to the printing head 112, and also, supplies power thereto. The printing head 112 and the flexible printed wiring cable are connected via a through hole 122*a* formed in the head holding part 122.

The driving mechanism holding part 123 has the motor 116 disposed on an arrow X2 side. An output shaft of the motor 116 extends to an arrow X1 side of the driving mechanism holding part 123 via a through hole 123*a*. A gear is connected to the output shaft. On the arrow X1 side of the driving mechanism holding part 123, a shaft 123*b* is formed for holding the reduction gear mechanism 117. The reduction gear mechanism 117 is loaded to the shaft 123*b*, and transmits a rotation of the output shaft of the motor 116 to the platen roller 114.

The paper guide block holding parts 124 are provided on both sides, i.e., the arrows X1, X2 directions of the base part 121. The paper guide block holding part 124 has projection parts 124*a* projecting in the arrow X2 direction. The projection parts 124*a* hold the paper guide block 113 rotatably.

[Printing Head 112]

Figure 3:
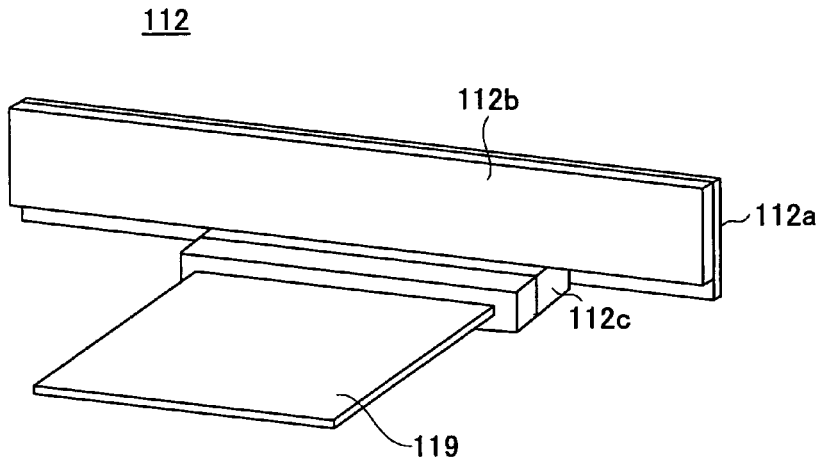
FIG. 3 shows a perspective view of a printing head 112.

FIG. 3 shows a perspective view of the printing head 112.

The printing head 112 includes a circuit substrate 112*a* on which a thermal head and a driving IC are mounted, a radiator plate 112*b* radiating unnecessary heat and a connector 112*c*. The connector 112*c* has a connector for the flexible printed wiring cable 119 connected thereto. The circuit substrate 112*a* receives power supply from the flexible printed wiring cable 119 via the connector 112*c*, drives the driving IC, heats the thermal head, and carries out printing on heat sensitive paper held between the thermal head and the platen roller 114.

[Paper Guide Block 113]

Figure 4:
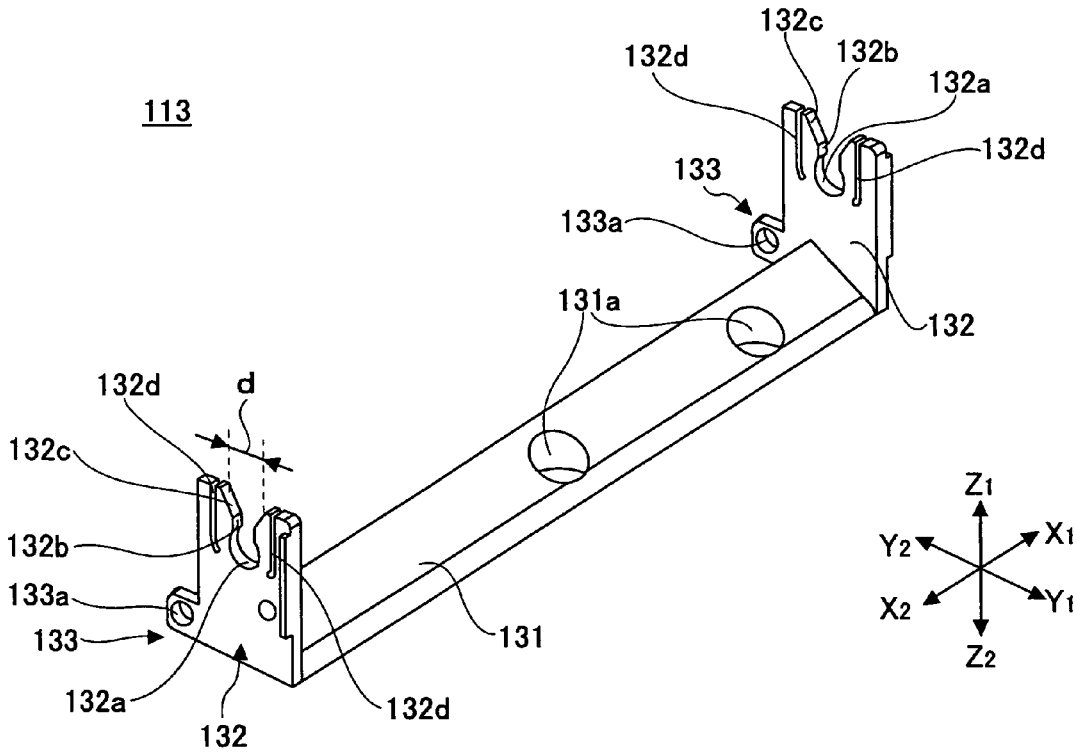
FIG. 4 shows a perspective view of a paper guide block 113.

FIG. 4 shows a perspective view of the paper guide block 113.

The paper guide block 113 has a configuration such that a paper guide part 131, bearing parts 132 and holding parts 133 are integrally molded of resin or such.

The paper guide part 131 extends in the arrows X1, X2 directions, inclines in the arrow Z1 direction along the arrow Y2 direction, curls the heat sensitive paper inserted from the arrow Y1 direction in the arrow Z1 direction, and guides the heat sensitive paper in between the printing head 112 and the platen roller 114. In the paper guide part 131, a through hole 131*a* passing through in the arrow Z1, Z2 directions is formed. The through hole 131*a* is formed at a position facing the sensor 120 mounted on the base part 121 of the frame 111.

The bearing parts 132 include bearings 132*a*, cut out parts 132*b*, introduction parts 132*c* and slit parts 132*d*. The bearing parts 132*a* hold a shaft of the platen roller 114 rotatably. The cut out parts 132*b* allows the arrow Z1 direction end parts of the bearing parts 132*a* to communicate with the outside.

The introduction parts 132*c* are formed on the arrow Z1 side in a taper manner such that each gap d reduces in width along the arrow Z2 direction. By pressing the shaft of the platen roller 114 to the introduction parts 132*b* in the arrow Z2 direction, the introduction parts 132*b* widen gradually in the arrow Y1, Y2 directions, and the cut out parts open in the arrow Y1, Y2 directions accordingly. Thereby, the shaft of the platen roller 114 can be easily loaded in the bearings 132*a*.

The slit parts 132*d* are formed on both sides of the bearings 132*a*, i.e., the arrow Y1 direction side and the arrow Y2 direction side. The slit parts 132*d* are provided for the purpose that, when the shaft of the platen roller 114 is inserted into the bearings 132*a*, the bearings 132*a* are deformed in such a manner that the cut out parts 132*b* open in the arrow Y1, Y2 directions.

Holding parts 133 are provided at positions on the arrow Z2 direction side of the arrow Y2 direction side of the bearings 132, and project in the arrow Y2 direction. In the holding parts 133, through holes 133*a* are formed which rotatably engage with the projection parts 124*a* formed on the paper guide block holding parts 124 of the frame 111. The paper guide block 113 is mounted on the paper guide block holding part 124 of the frame 111 rotatably about the holding parts 133.

[Platen Roller 114]

As shown in FIG. 1, the platen roller 114 includes a rotating shaft 114*a*, a roller 114*b* and a gear 114*c*. The rotating shaft 114 is made of a metal rod or such. The roller 114*b* is made of a resin material disposed cylindrically about the rotating shaft 114*a*, presses heat sensitive paper in the direction of the printing head 112, feeds the heat sensitive paper in the arrow Z1 direction, and also, causes the heat sensitive paper to contact the printing head 112.

The gear 114*c* is fixed to the rotating shaft 114*a*. Further, the gear 114*c* engages with the reduction gear mechanism 117, and the rotating shaft 114*a* is rotated in an arrow ϕ1 direction by means of a rotating driving force transmitted by the reduction gear mechanism 117. The platen roller 114 rotates according to the rotation of the reduction gear mechanism 117, and rotates the roller 114*b* in the arrow ϕ1 direction. Thus, the heat sensitive paper is fed in the arrow Z1 direction.

[Coil Spring]

The coil springs 115 are held by the coil spring holding parts 121*a* provided on the base part 121 of the frame 111.

[Motor 116]

The motor 116 is made of, for example, a stepping motor, and is mounted in the driving mechanism holding part 123 of the frame 111. The motor 116 generates rotating force and transmits it to the reduction gear mechanism 117.

[Reduction Gear Mechanism 117]

The reduction gear mechanism 117 includes a plurality of gears. The plurality of gears are rotatably supported by shafts in such a manner that they together engage with the shaft 123*b* of the driving mechanism holding part 123 of the frame 111.

[Gear Cover 118]

A gear cover 118 is loaded on the frame 111, and covers the motor 116 and the reduction gear mechanism 117.

[Flexible Printed Wiring Cable 119]

One end of the flexible printed wiring cable 119 is connected to a controller, not shown, the other end is connected to the printing head 112, the motor 116 and the sensor 120, supplies power to the printing head 112, the motor 116 and the sensor 120 and also, transmits a signal to the controller.

[Sensor]

The sensor 120 is made of a reflective type photo-interrupter, and is mounted on the base part 121 of the frame 111. The sensor 120 is connected to the flexible printed wiring cable 119, and is driven thereby. Light emitted by the sensor 120 exits through the through hole 131*a* of the paper block guide 113.

An output signal of the sensor 120 has a high level when the paper is located on the through hole 131*a* in a state in which the paper guide block 113 is rotated in an arrow θ2 direction, since the paper is in the proximity to the sensor 120. Further, the output signal of the sensor 120 has a low level when the paper is not located on the through hole 131*a* in a state in which the paper guide block 113 is rotated in the arrow θ2 direction, since the light emitted by the sensor 120 exits through the though hole 131*a*. Further, in a state in which the paper guide block 113 is rotated in an arrow θ1 direction, the light emitted by the sensor 120 exits through the through hole 131*a*, and thus, the output signal of the sensor has the low level. Further, when the paper is located on the through hole 131*a* in a state in which the paper guide block 113 is rotated in an arrow θ1 direction, the light emitted by the sensor 120 is reflected by the paper and returns. However, in this case, since the distance from the paper is long, the output signal of the sensor 120 has an intermediate level. Thus, by detecting the output signal level and the intermediate level of the sensor 120 by means of a signal processing circuit not shown, it is possible to detect, not only existence/absence of the paper but also existence/absence of the platen roller 114.

Thus, by means of the sensor 120, it is possible to detect existence/absence of the paper and existence/absence of the platen roller 114. It is noted that, the sensor 120 is not limited to the reflective type photo-interrupter. Instead, a photo-sensor, a photo-coupler, or such, may be applied.

[Operation]

Figure 5:
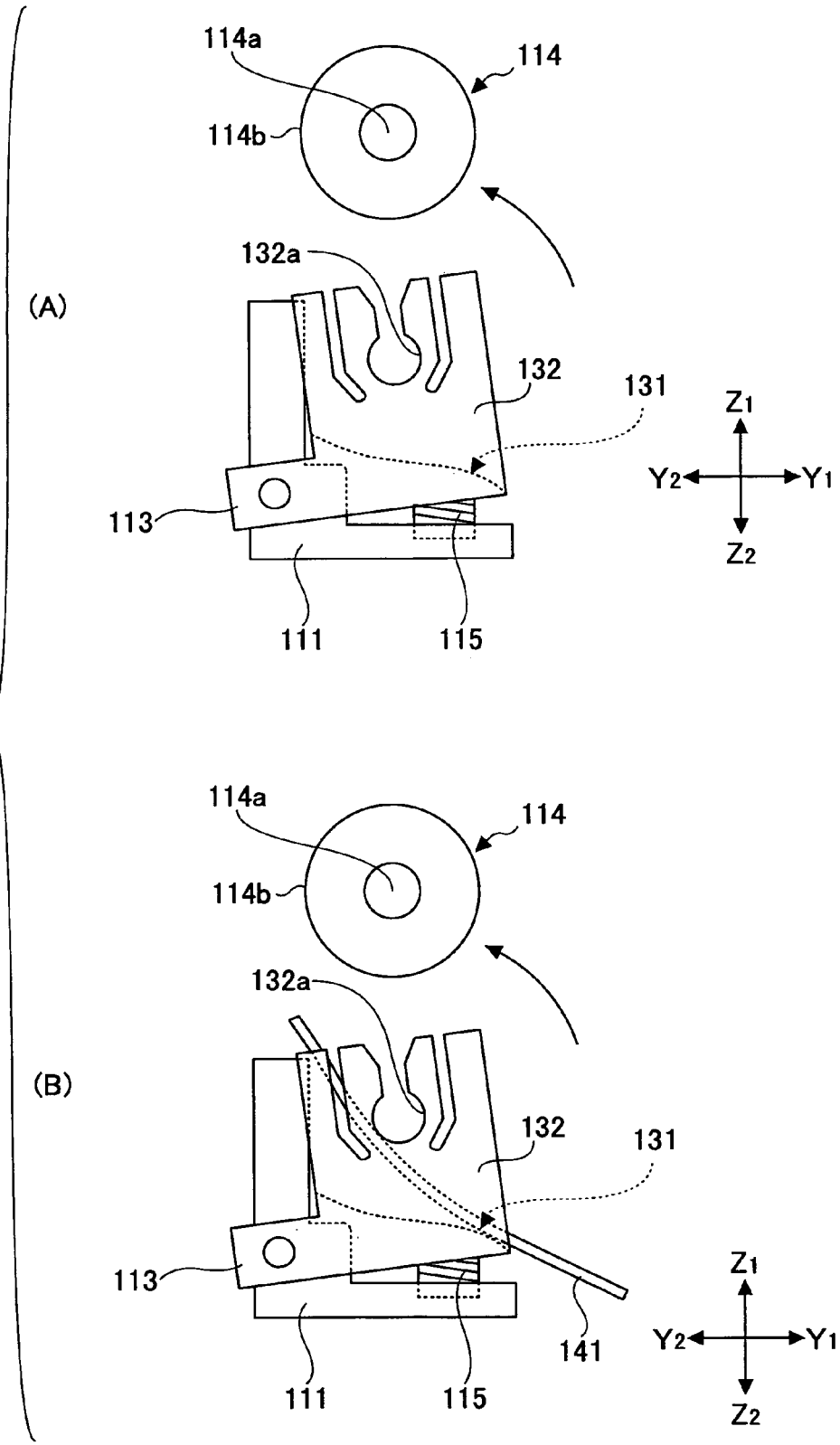
FIGS. 5 and 6 illustrate operation of the first embodiment of the present invention.
Figure 6:
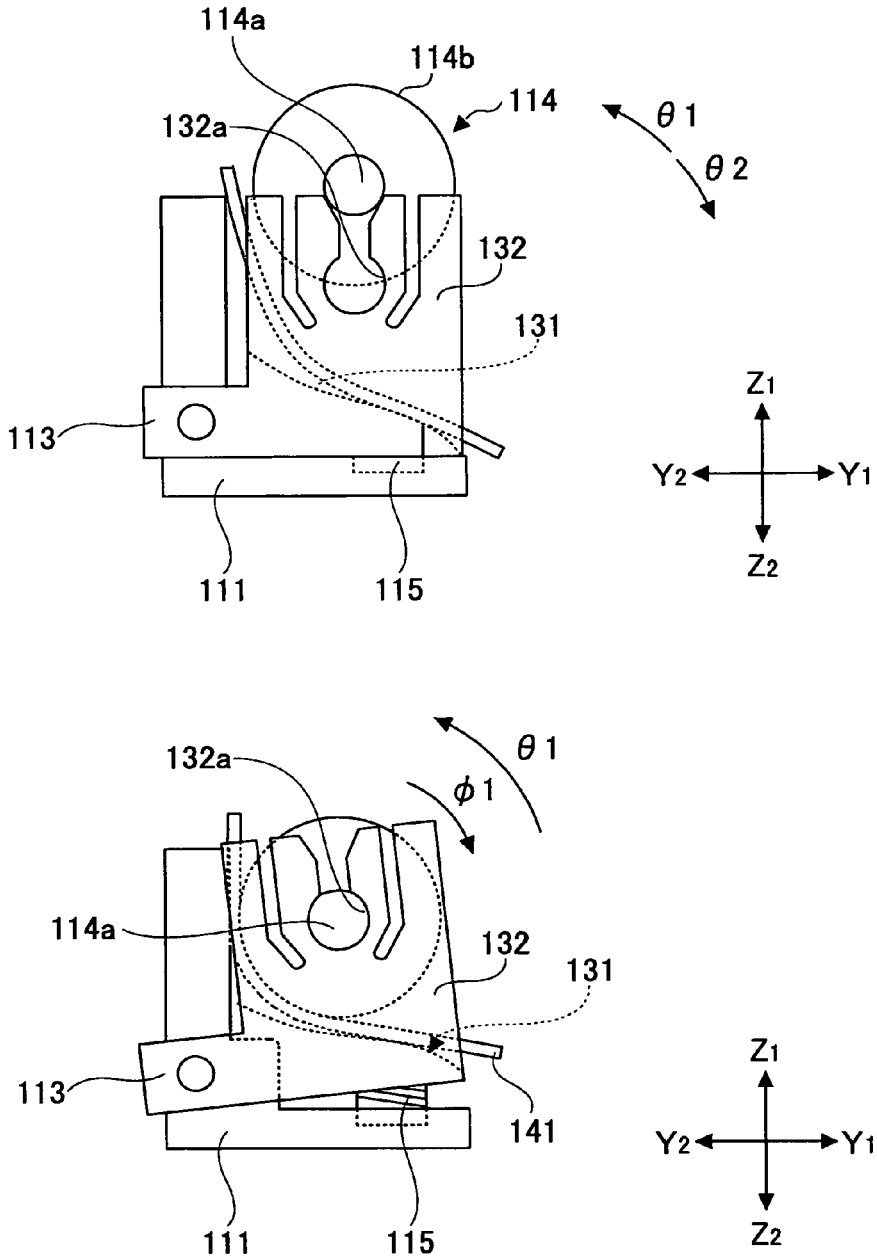

FIGS. 5 and 6 illustrate operation of the first embodiment of the present invention described above.

When the paper is to be loaded, as shown in FIG. 5(A), the platen roller 114 is to be removed from the paper guide block 113. In a state in which the platen roller 114 is removed from the paper guide block 113, the coil springs 115 are pressed in the arrow θ1 direction.

In this state, the heat sensitive paper 141 is to be placed on the paper guide part 121*a* of the paper guide block 113, as shown in FIG. 5(B). Next, as shown in FIG. 6(A), the platen roller 114 is to be mounted in the paper guide block 113. At this time, the rotating shaft 114*a* of the platen roller 114 is pressed into the beating parts 132 of the paper guide block 113 from the arrow Z1 direction to the arrow Z2 direction. Thereby, the paper guide block 113 rotates in the arrow θ2 direction against a resilient force of the springs 115. As a result of the paper guide block 113 rotating in the arrow θ2 directions against the resilient force of the springs 115, the bottom surface of the paper guide part 131 comes into contact with the base part 121 of the frame 111, and thus, the rotation of the paper guide block 113 is inhibited.

When the platen roller 114 is released after the platen roller 114 is thus loaded in the bearings 132*a* of the paper guide block 113, the resilient force of the coil springs 115 causes the paper guide block 113 to rotate in the arrow θ1 direction. As a result, the platen roller 114 is pressed onto the printing head 112 in a condition in which the heat sensitive paper 114 is held therebetween, as shown in FIG. 6(B).

When the reduction gear mechanism 117 rotates according to the rotation of the motor 116, the platen roller 114 rotates in the arrow θ1 direction. As a result of the platen roller 114 rotating in the arrow θ1 direction, the heat sensitive paper 114 is fed in the arrow Z1 direction. Printing on the heat sensitive paper 114 is carried out as a result of the heat sensitive paper 141 being thus fed in the arrow Z1 direction and the printing head 112 being driven.

[Effect]

In this embodiment, as a result of the paper guide and the bearings of the platen roller 114 being thus integrally formed in the paper guide block 113, the number of the components can be reduced. At this time, as a result of the paper guide block 113 being integrally molded of resin, it is possible that the rotating shaft 114*a* of the platen roller 114 can be directly received, and thus, it is possible to further reduce the number of components.

Further, in this embodiment, the paper guide block 113 is rotatably held by the frame 111, and the coil springs 115 inserted between the bottom surface of the paper guide block 113 and the base part 121 of the frame 111 press the paper guide block 113 in the direction of the printing head 112. As a result, the printing head 112 can be fastened to the frame 111, and thus, no space is required between the printing head 112 and the frame 111. Alternatively, it is possible to utilize a space between the printing head 112 and the frame 111, for example, for holding another device such as a card reader or such.

Further, in this first embodiment, since the paper guide part 131 and the bearings 132 holding the platen roller 114 are integrally formed in the paper guide block 113, it is possible to easily handle paper of a different width, merely by changing the width in the arrow X1, X2 directions of the paper guide part 131 without changing the other portions.

Second Embodiment

Figure 7:
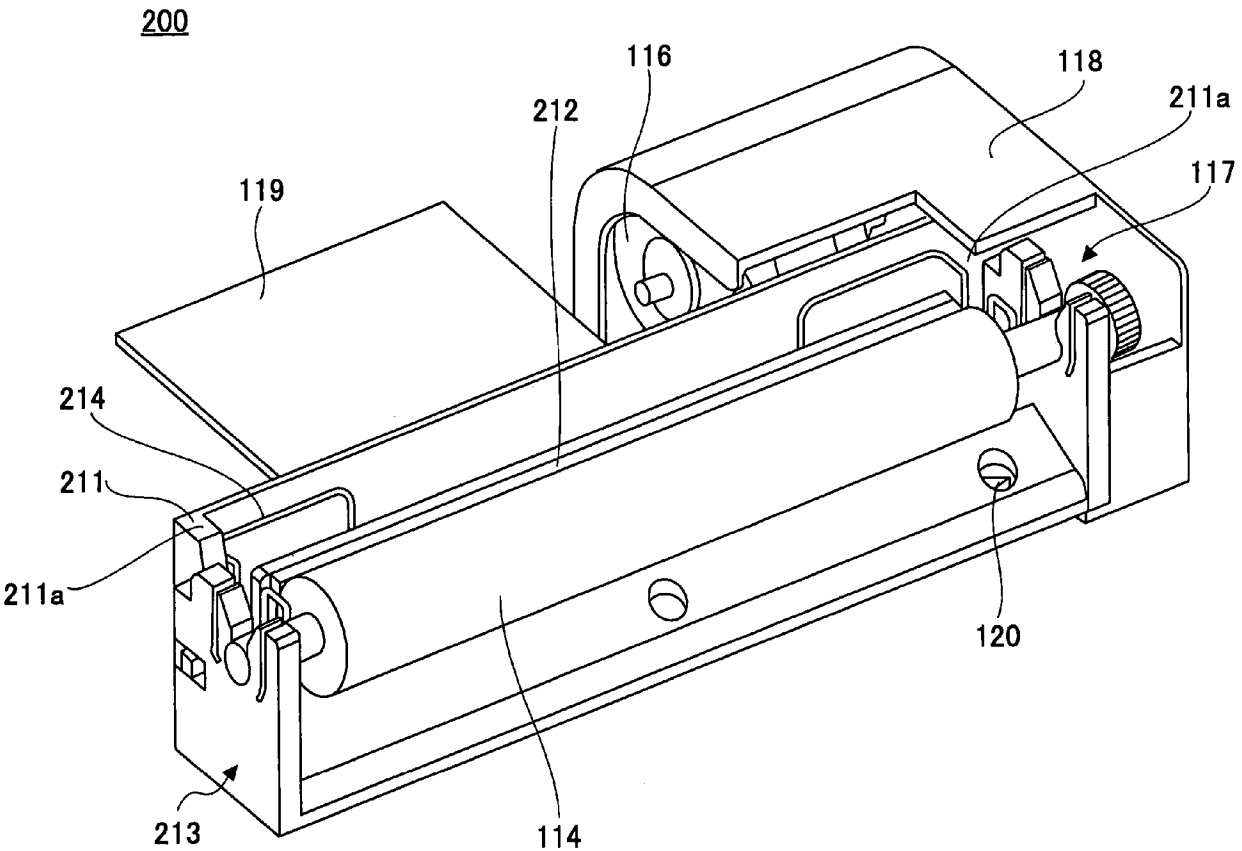
FIG. 7 shows a perspective view of a second embodiment of the present invention.

FIG. 7 shows a perspective view of a second embodiment of the present invention. In FIG. 7, the same reference numerals are given to parts/components the same as those of FIG. 1, and duplicate description is omitted.

A printing apparatus 200 in the second embodiment is different from the first embodiment in a frame 211, a printing head 212, a paper guide block 213, and a ground rod spring 214. In the printing apparatus 200 in the second embodiment, the paper guide block 213 is fixed to the frame 111, and the printing head 212 is pressed onto the paper guide block 213 by means of the ground rod spring 214.

[Frame 211]

Figure 8:
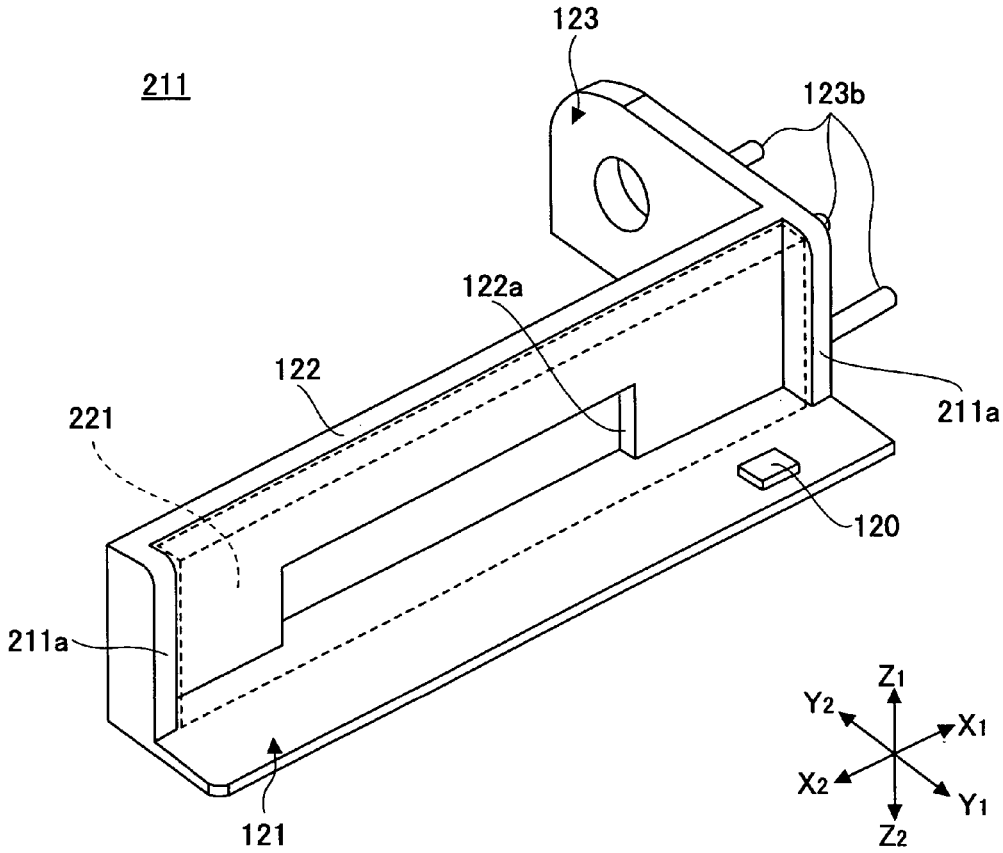
FIG. 8 shows a perspective view of a frame 211.

FIG. 8 shows a perspective view of the frame 211. In the figure, the same reference numerals are given to the parts/components the same as those of FIG. 2, and the duplicated description is omitted.

In the frame 211, instead of the paper guide block 124, a spring holding part 221 is formed in the arrow Y1 direction side of the head holding part 122. The spring holding part 221 is formed in such a manner that wall parts 211*a* are formed on arrow X1, X2 direction end parts of the frame 211. The ground rod spring 214 is held by the spring holding part 221.

[Printing Head 212]

Figure 9:
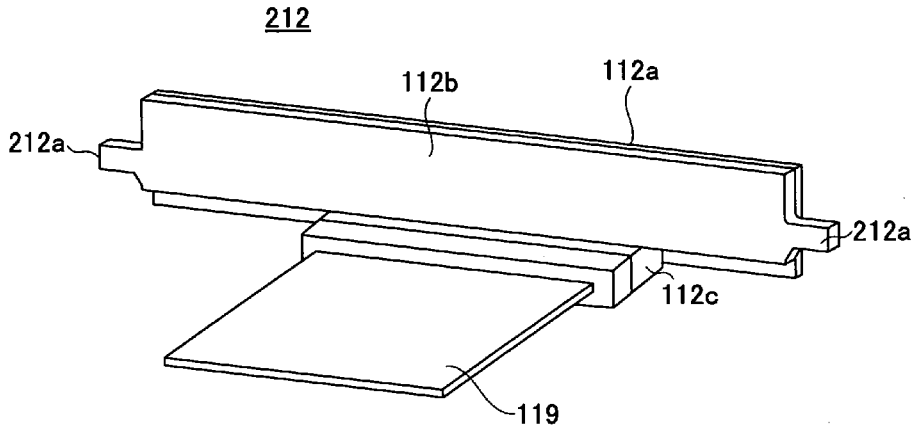
FIG. 9 shows a perspective view of a printing head 212.

FIG. 9 shows a perspective view of the printing head 212. In FIG. 9, the same reference numerals are given to parts/components the same as those of FIG. 3, and duplicate description is omitted.

The printing head 212 has, on its both sides, projection parts 212*a* which engage with the paper guide block 213 swingably in the arrow Y1, Y2 directions. The printing head 212 has a force applied thereto in the direction of the paper guide block 212 by means of the ground rod spring 214 which is inserted into the spring holding part 221 between the printing head 212 and the frame 211.

It is noted that the spring holding part 221 is configured in such a manner that a surface of the printing head 212 in the arrow Y2 direction side comes into contact with the wall parts 211*a* of the frame 211.

[Paper Guide Block 213]

Figure 10:
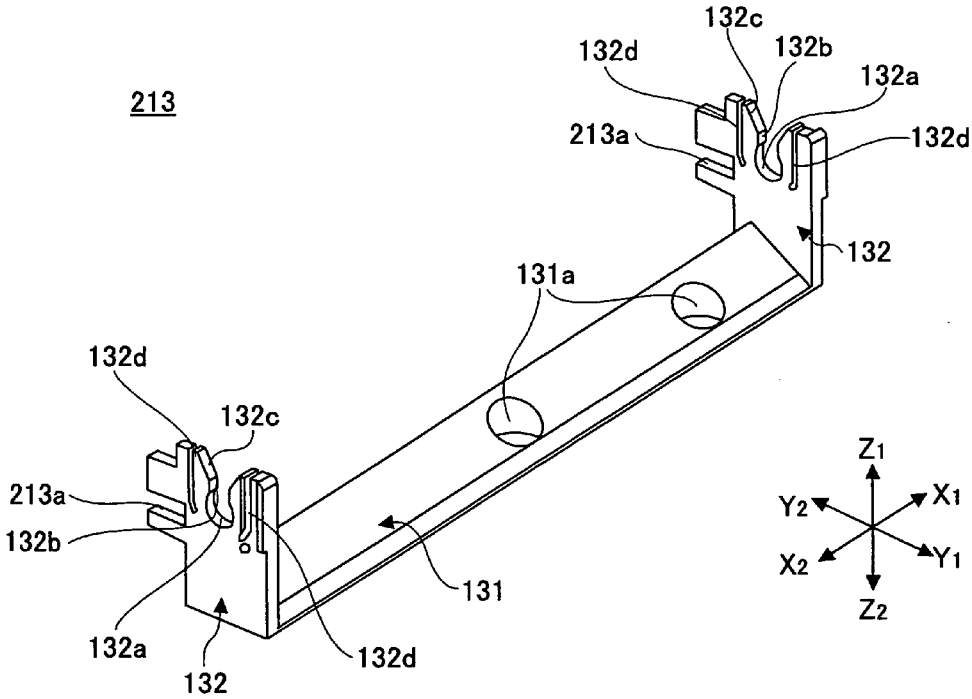
FIG. 10 shows a perspective view of a paper guide block 213.

FIG. 10 shows a perspective view of the paper guide block 213. In FIG. 10, the same reference numerals are given to parts/components the same as those of FIG. 4, and duplicate description is omitted.

The paper guide block 213 in the second embodiment is fixed to the frame 211, and, has a head swinging part 213*a* which holds the printing head 212 in the bearing parts 132 swingably in the arrow Y1, Y2 directions, instead of the holding part 133.

[Ground Rod Spring 214]

Figure 11:
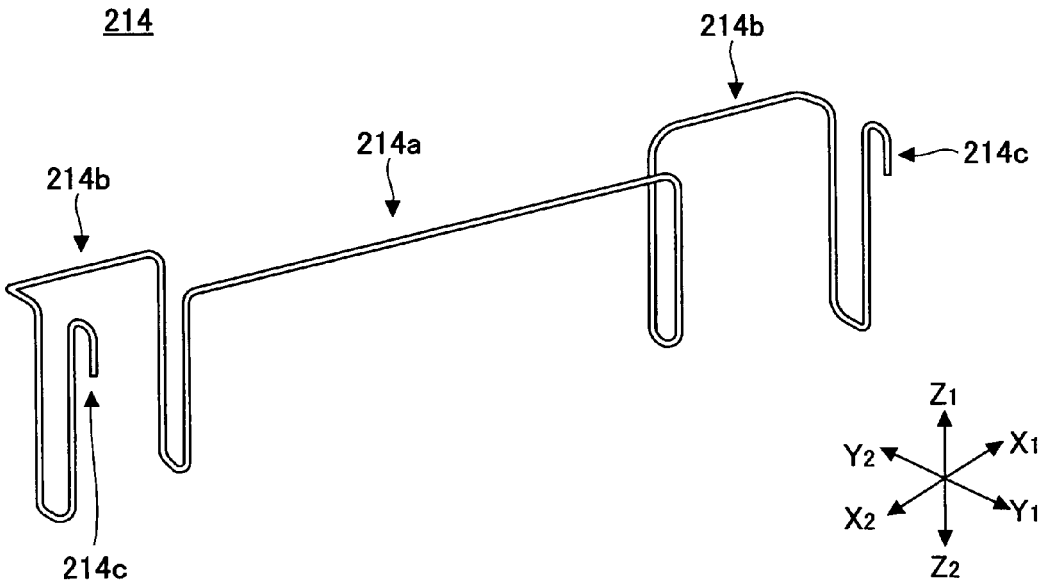
FIG. 11 shows a perspective view of a ground rod spring 214.

FIG. 11 shows a perspective view of the ground rod spring 214.

The ground rod spring 214 has a configuration in which an electrically conductive elastic wire is bent, and has a pressing part 214*a*, connecting parts 214*b* and contacting parts 214*c*.

The pressing part 214*a* is loaded in the spring holding part 221 formed between the head holding part 122 of the frame 211 and the printing head 212, and presses the printing head 212 in the direction of the platen roller 114, i.e., in the arrow Y1 direction. The connecting parts 214*b* extend along the arrow X1, X2 directions from the both ends of the pressing part 214*a*, and are bent so that they extend to the both ends of the printing head 212, then extend to a bottom part of the projection part 212*a* of the printing head 212 in the arrow Z2 direction and then reach around the shaft of the platen roller 114.

The contacting parts 214*c* are provided at the extending ends of the connecting parts 214*b*. The contacting parts 214*c* come into contact with the rotating shaft 114*a* of the platen roller 114 when the platen roller 114 is loaded in the bearing parts 132 of the paper guide block 213. The contacting parts 214*c* thus come into contact with the rotating shaft 114*a* of the platen roller 114, and as a result, the platen roller 114 is connected with the ground rod spring 214, and is grounded through the frame 211. Thereby, electrostatic charge occurs due to friction of the heat sensitive paper or such can be discharged to the ground.

[Operation]

Figure 12:
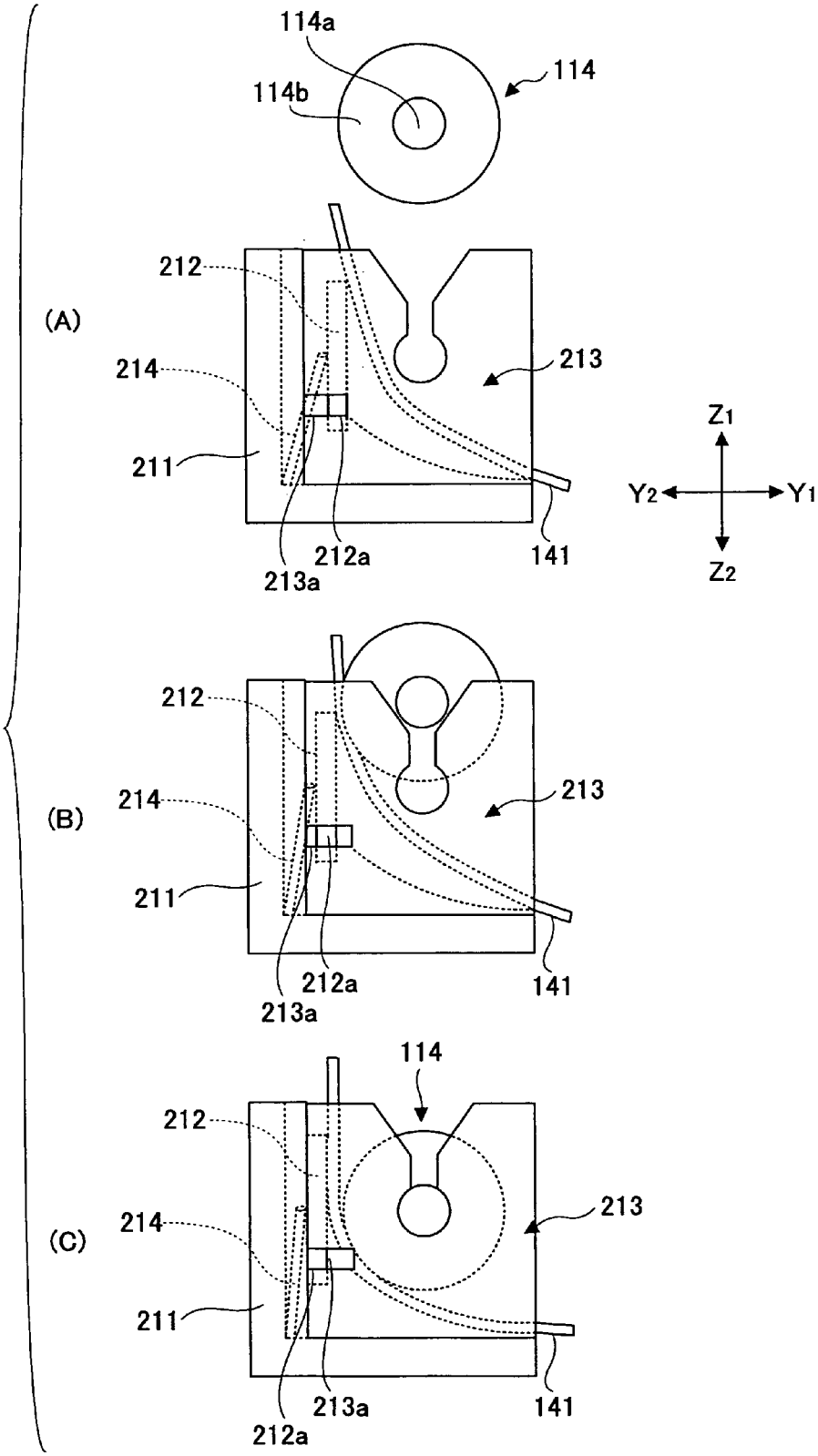
FIG. 12 illustrates operation of the second embodiment of the present invention.

FIG. 12 illustrates operation of the second embodiment of the present invention.

When paper is to be loaded, as shown in FIG. 12(A), the platen roller 114 is to be removed from the paper guide block 213. When the platen roller 114 is thus removed from the paper guide block 213, the printing head 212 is in a state in which it is pressed in the arrow Y1 direction by means of the ground rod spring 214.

In this state, the heat sensitive paper 141 is to be placed in the paper guide part 121*a* of the paper guide block as shown in FIG. 12(B). Then, as shown in FIG. 12(C), the platen roller 114 is to be mounted in the paper guide block 213. At this time, by means of the platen roller 114, the printing head 212 is pressed in the arrow Y2 direction against a resilient force of the ground rod spring 214 in a state in which the heat sensitive paper 141 is held. Thereby, the paper can be fed, and printing thereto can be made.

Third Embodiment

Figure 13:
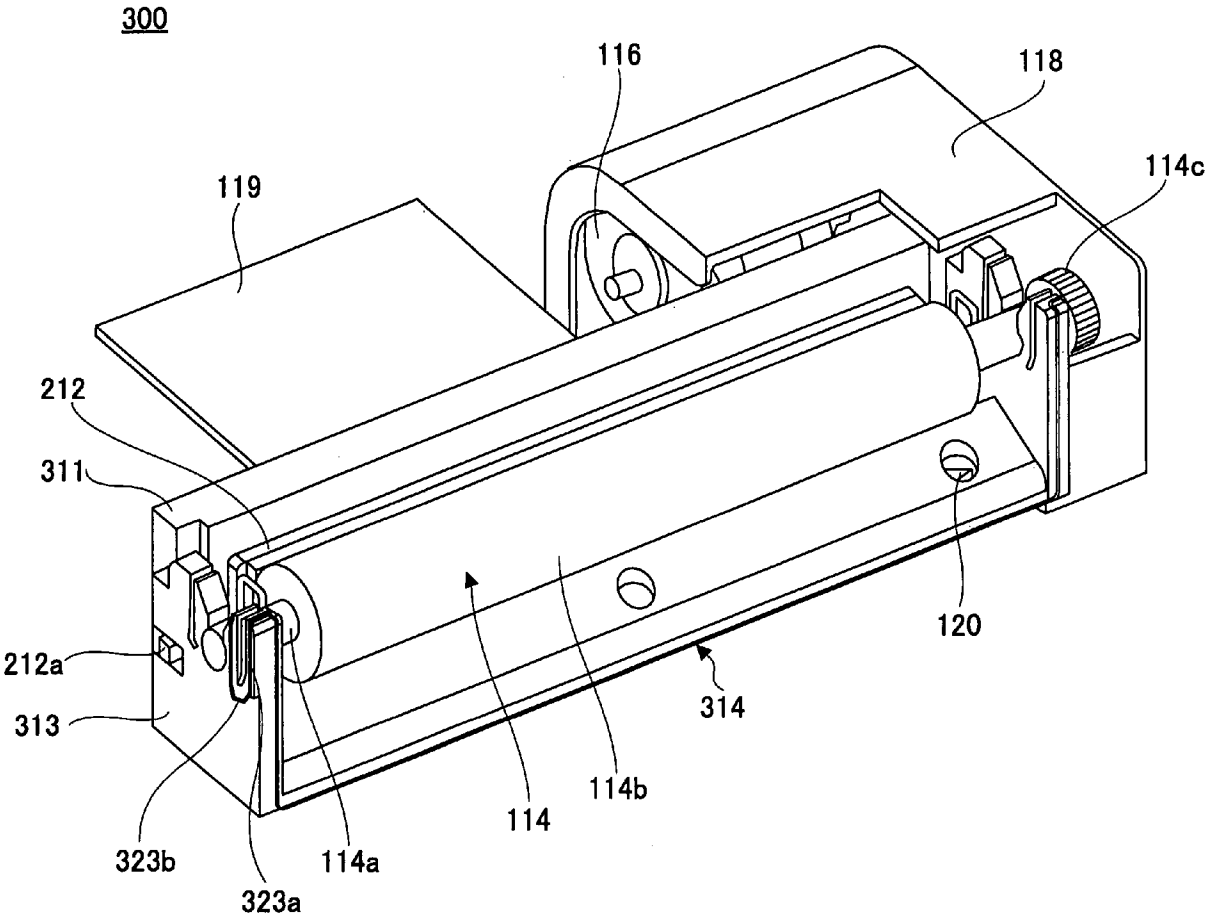
FIG. 13 shows a perspective view of a third embodiment of the present invention.

FIG. 13 shows a perspective view of a third embodiment. In FIG. 13, the same reference numerals are given to parts/components the same as those of FIG. 7, and duplicate description is omitted.

A printing apparatus 300 of the third embodiment is different from the second embodiment in a frame 311, a printing head 212, a paper guide block 313 and a U-spring 314. In the printing apparatus 300, the printing head 212 and the paper guide block 313 are fixed to the frame 311, and the rotating shaft 114*a* of the platen roller 114 is pressed in the arrow Y2 direction by means of the U-spring 314. Thereby, the platen roller 114 and the printing head 212 hold the paper therebetween.

[Frame 311]

Figure 14:
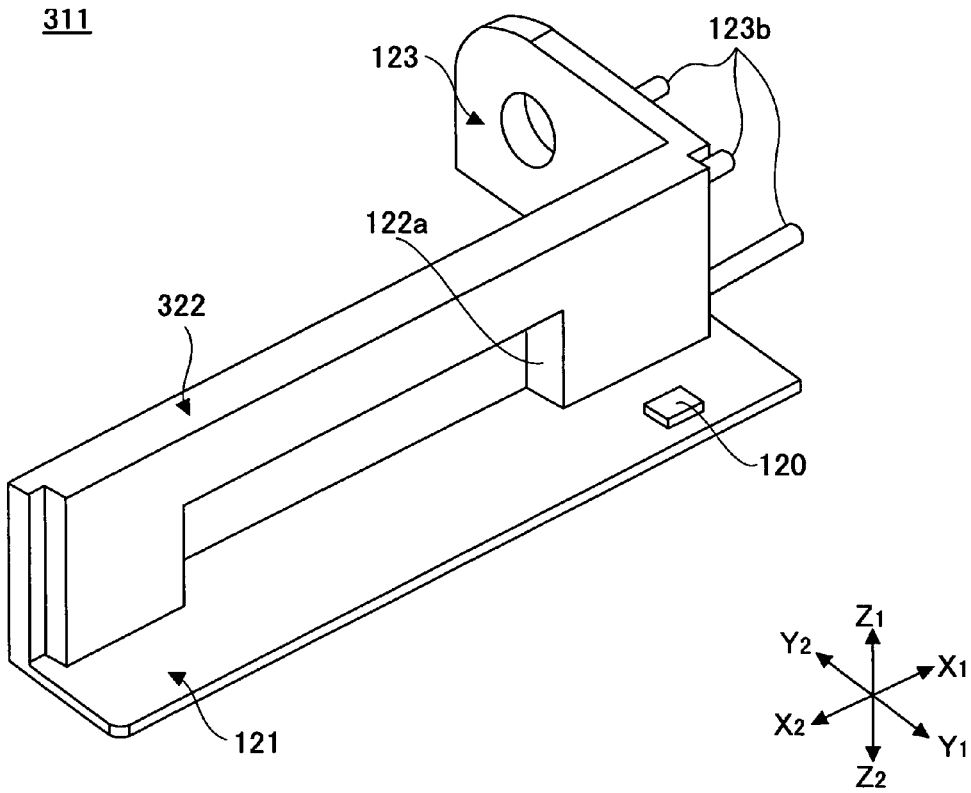
FIG. 14 shows a perspective view of a frame 311.

FIG. 14 shows a perspective view of the frame 311. In FIG. 14, the same reference numerals are given to parts/components the same as those of FIG. 8, and duplicate description is omitted.

The frame 311 is different from the frame 211 of the second embodiment in a configuration of a head holding part 322. The head holding part 322 in the third embodiment has a shape such that a front surface thereof, i.e., the surface on the arrow Y1 side projects forward, in the arrow Y1 direction. The printing head 212 is fixed to the head holding part 322.

[Paper Guide Block 313]

Figure 15:
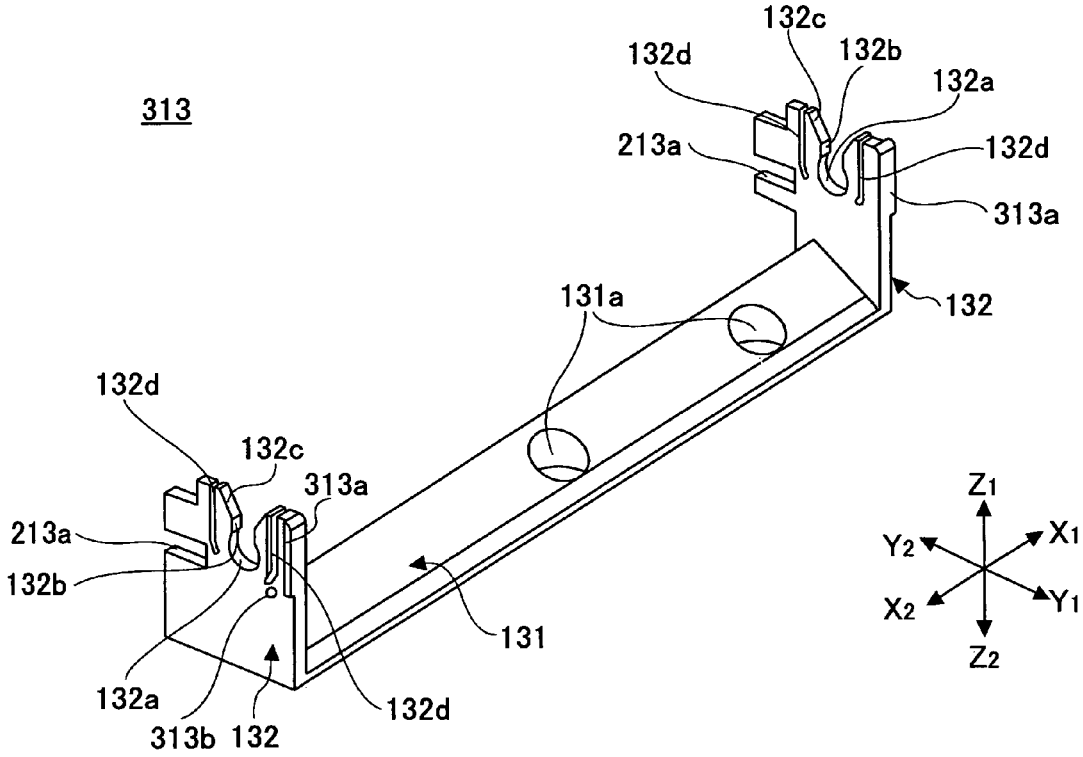
FIG. 15 shows a perspective view of a paper guide block 313.
Figure 16:
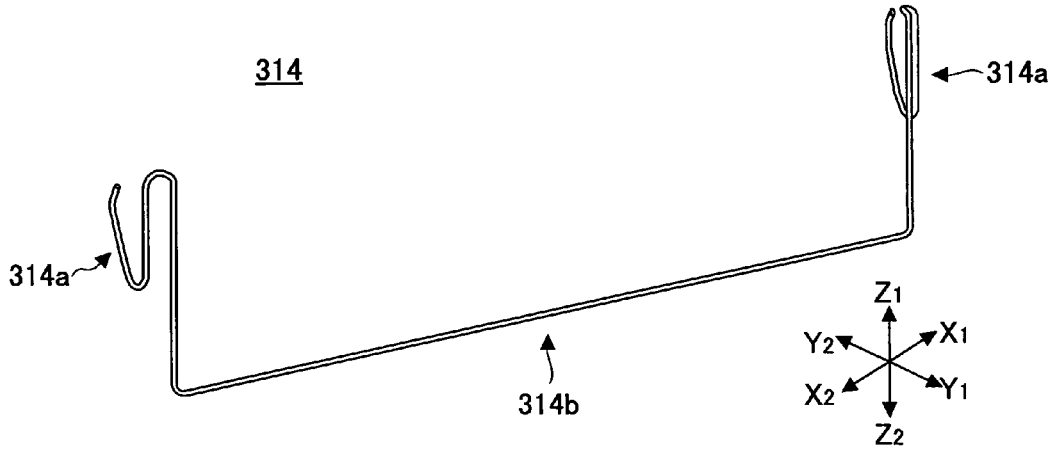
FIG. 16 shows a perspective view of a U-spring 314.

FIG. 15 shows a perspective view of the paper guide block 313. In FIG. 15, the same reference numerals are given to parts/components the same as those of FIG. 4, and duplicate description is omitted.

The paper guide block 313 in the third embodiment has a shape such that first projection parts 313*a* and second projection parts 313*b* are formed forward of outer side surfaces of the bearing parts 132, i.e., on the arrow Y1 direction side. The U-spring 314 engages with the first projection parts 313*a* and the second projection parts 313*b*.

The first projection parts 313*a* project at a top part of a front surface of the bearing parts 132, outward, i.e., in the arrow X1, X2 directions, and the U-spring 314 engages with the top ends thereof. The second projection parts 313*b* engage with a bottom side part of the U-spring 314.

[U-Spring 314]

The U-spring 314 has a configuration in which a resilient wire is bent, and has pressing parts 314*a* and a connecting part 314*b*.

The pressing parts 314*a* have a U-shape, engage with the first projection parts 313*a* and the second projection parts 313*b* on the outside of the bearing parts 132 of the paper guide block 313, have a force applied thereto in the arrow Y1 direction when the platen roller 114 is loaded in the bearings 132*a*, and press the rotating shaft 114*a* of the platen roller 114 in the arrow Y2 direction.

The pressing parts 314*a* are connected with the connecting part 314*b* together. The connecting part 314*b* passes on the arrow Y1 direction side end of the bearing part 132 of the paper guide block 313, reaches the front surface end of the paper guide part 131 of the paper guide block 313, and is led to the bearing part 132 of the other end.

Figure 17:
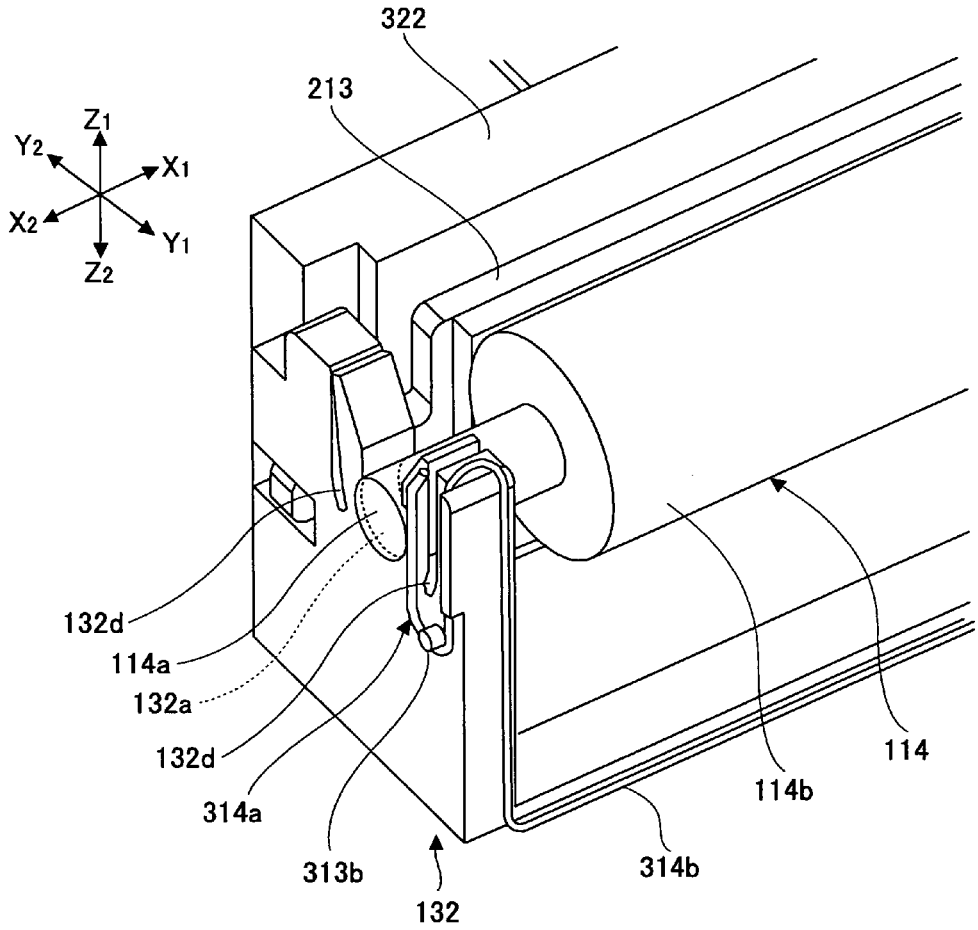
FIG. 17 shows a perspective view of a relevant part in a state in which the U-spring 314 is mounted in the paper guide block 313.

FIG. 17 shows a perspective view of a relevant part in a state in which the U-spring 314 is mounted on the paper guide block 313.

As shown in FIG. 17, the U-spring 314 presses the rotating shaft 114*a* of the platen roller 114 in the arrow Y2 direction, and the roller 114*b* of the platen roller 114 is pressed onto the printing head 213. Thereby, the roller 114*b* of the platen roller 114 and the printing head 213 can hold the heat sensitive paper therebetween.

[Operation]

Figure 18:
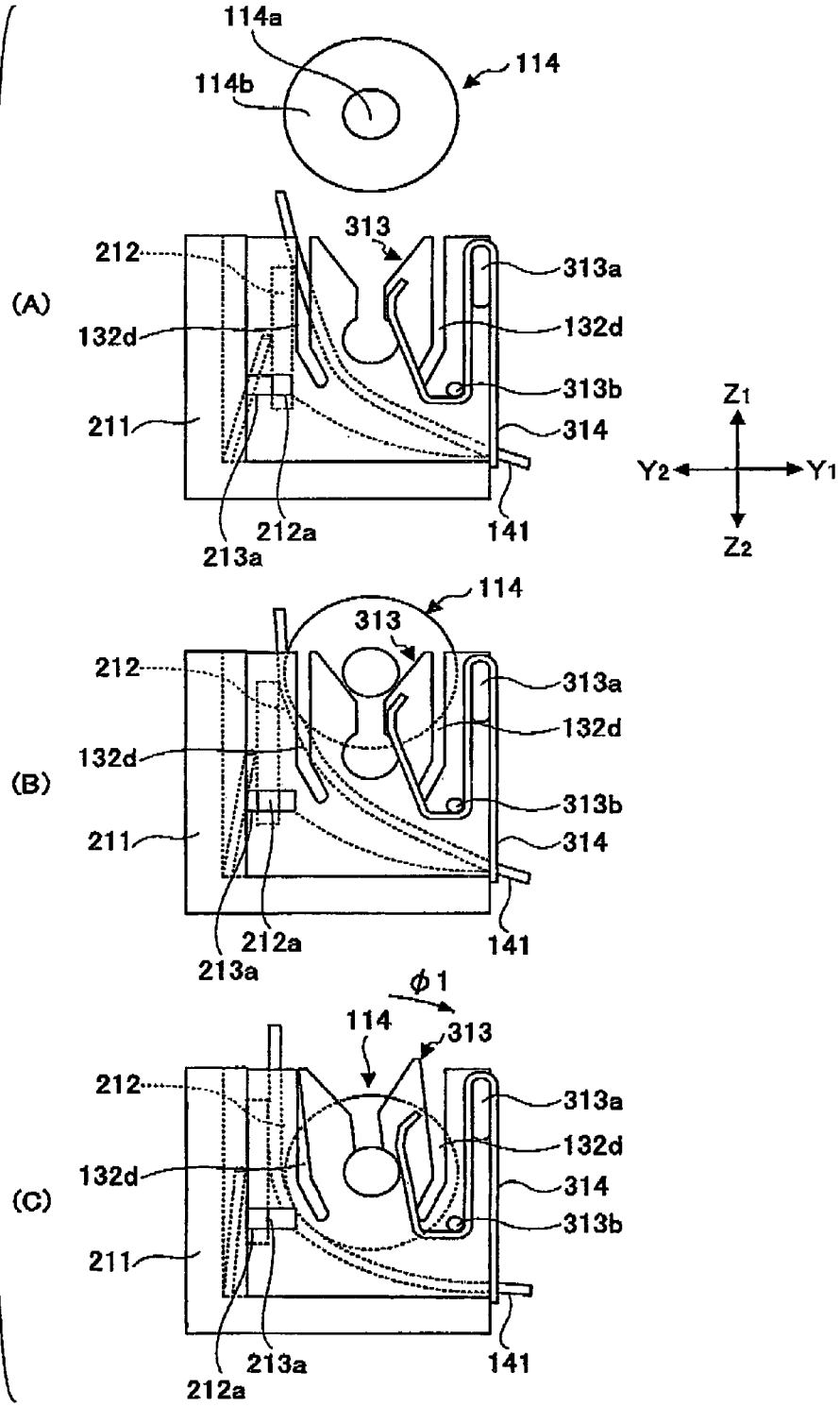
FIG. 18 illustrates operation of the third embodiment of the present invention.

FIG. 18 illustrates operation of the third embodiment.

When the paper is to be loaded, the platen roller 114 is to be removed from the paper guide block 213 as shown in FIG. 18(A). In a state in which the printing head 212 is thus removed from the paper guide block 213 of the platen roller 114, the pressing parts 314*a* of the U-spring 314 is released in the arrow Y2 direction. Further, the bearings 132*a* of the paper guide block 313 are also released in the same manner.

In this state, the heat sensitive paper 141 is to be placed on the paper guide part 121*a* of the paper guide block 313 as shown in FIG. 18(B). Next, as shown in FIG. 18(C), the platen roller 114 is to be mounted in the paper guide block 213. As a result, the pressing parts 314*a* of the U-spring 314 are pressed by the rotating shaft 114*a* of the platen roller 114 in the arrow Y1 direction, and along therewith, the rotating shaft 114*a* of the platen roller 114 has a force applied in the arrow Y2 direction. As a result of the rotating shaft 114*a* of the platen roller 114 being thus pressed in the arrow Y2 direction, the bearings 132*a* of the paper guide block 313 is deformed in the arrow Y2 direction, and the roller 114*b* of the platen roller 114 is pressed onto the printing head 213 via the heat sensitive paper 141.

When the reduction gear mechanism 117 rotates along with rotation of the motor 116, the platen roller 114 rotates in the arrow ϕ1 direction. As a result of the platen roller 114 thus rotating in the arrow ϕ1 direction, the heat sensitive paper 141 is fed in the arrow Z1 direction. Along with the heat sensitive paper 141 being thus fed in the arrow Z1 direction, the printing head 112 is driven, and thereby, printing is carried out on the heat sensitive paper 141.

Fourth Embodiment

Figure 19:
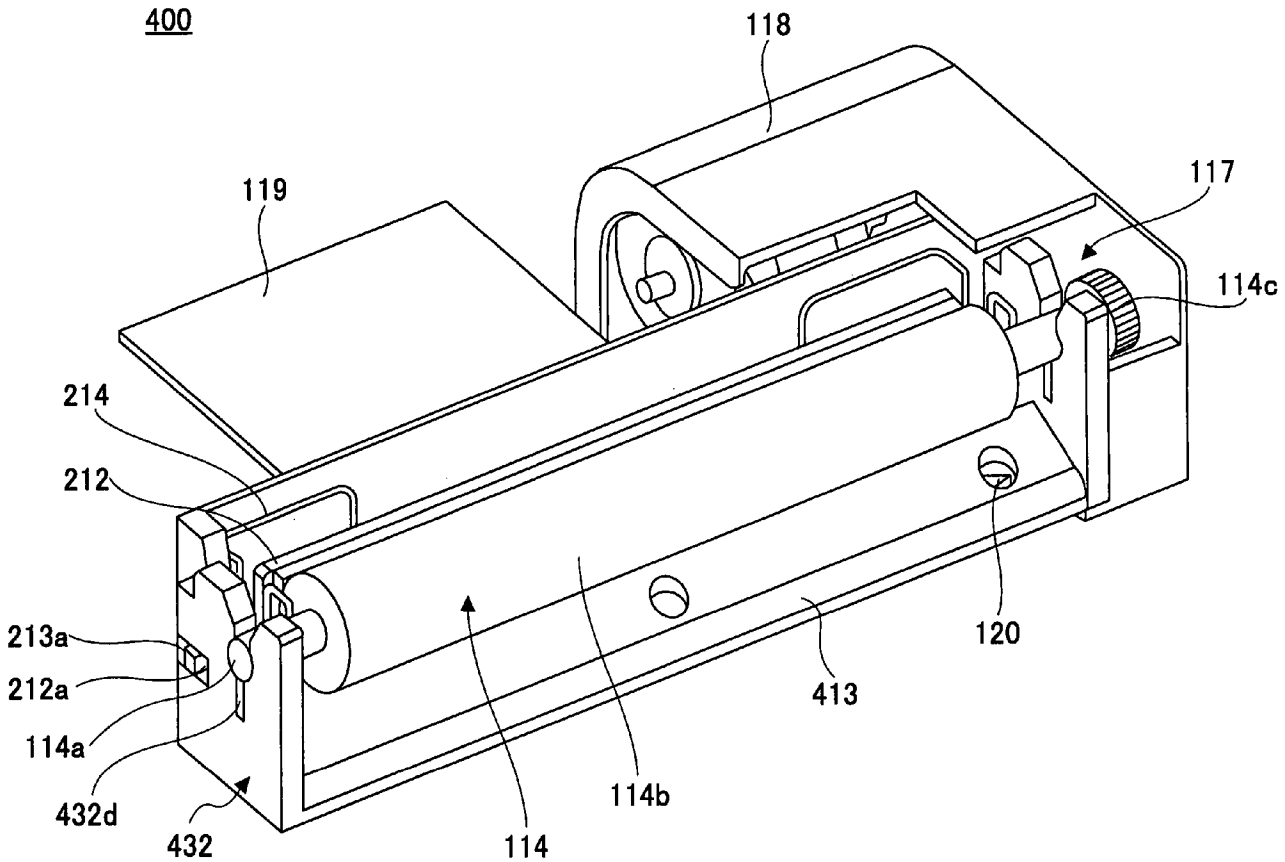
FIG. 19 shows a perspective view of a fourth embodiment of the present invention.

FIG. 19 shows a perspective view of a fourth embodiment of the present invention. In FIG. 19, the same reference numerals are given to parts/components the same as those of FIG. 7, and duplicate description is omitted.

A printing apparatus 400 in the fourth embodiment is different from the printing apparatus in the third embodiment in a configuration of a paper guide block 413. Further, in the paper guide block 413 in the fourth embodiment, a configuration of bearing parts 432 is different from that of the paper guide block 313.

[Paper Guide Block 413]

Figure 20:
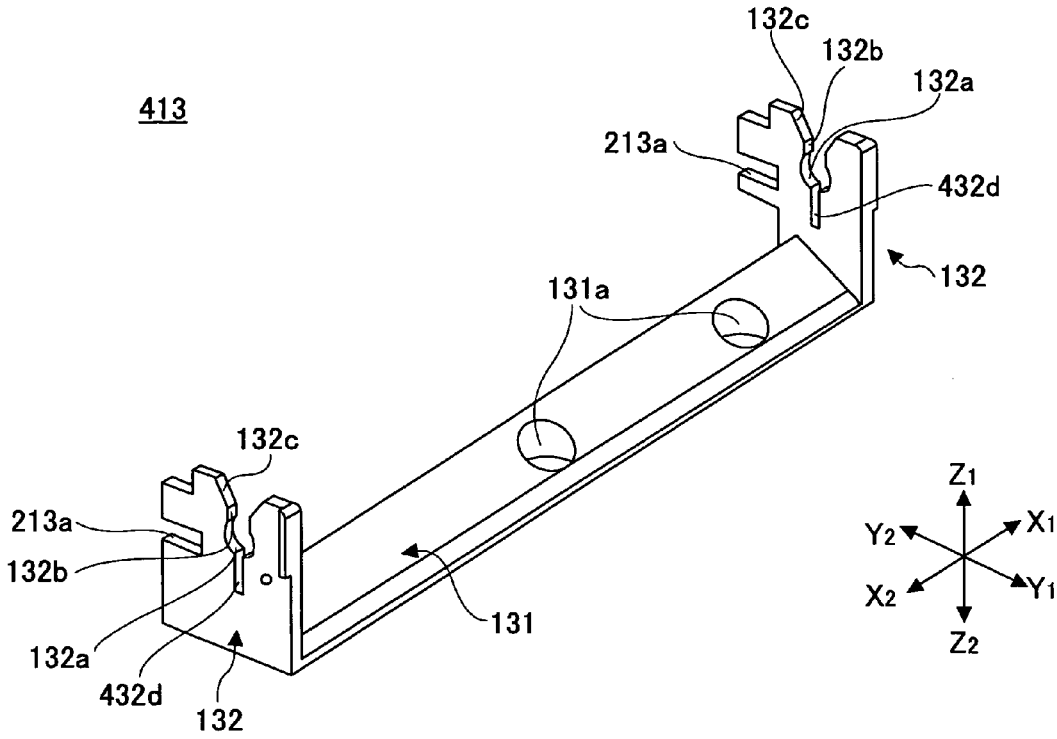
FIG. 20 shows a perspective view of a paper guide block 413.
Figure 21:
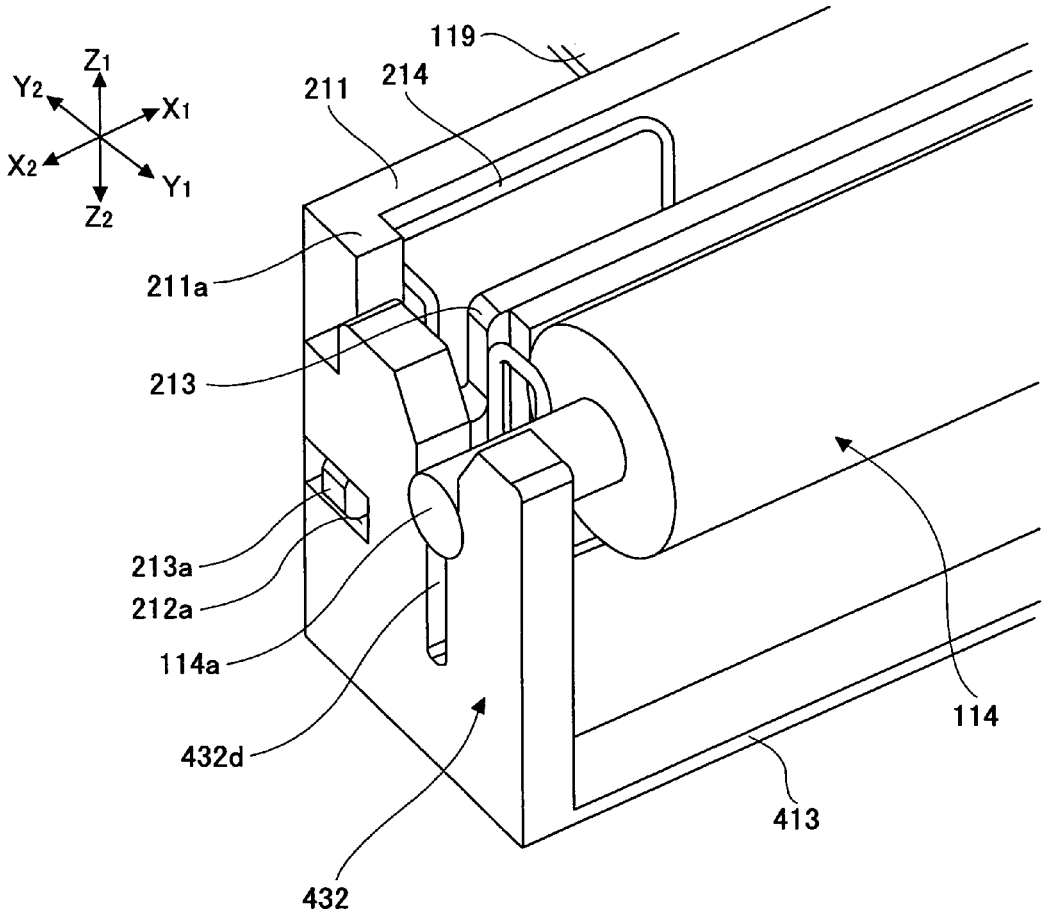
FIG. 21 shows a perspective view of a paper guide block 413 at a time of assembling.

FIG. 20 shows a perspective view of the paper guide block 413, and FIG. 21 shows a perspective view of a relevant part of the paper guide block 413 during assembling. In the figures, the same reference numerals are given to parts/components the same as those of FIG. 4, and duplicate description is omitted.

The paper guide block 413 has, U-grooves 432*d* instead of the slit parts 132*d*. The U-grooves 432*d* are formed to the bottom of the bearings 132*a*, i.e., in the arrow Z2 direction. By means of the U-grooves 432*d*, the cut out parts 132*b* are easily opened in the arrow Y1, Y2 directions when the rotating shaft 114*a* of the platen roller 114 is loaded in the bearings 132*a*.

Fifth Embodiment

Figure 22:
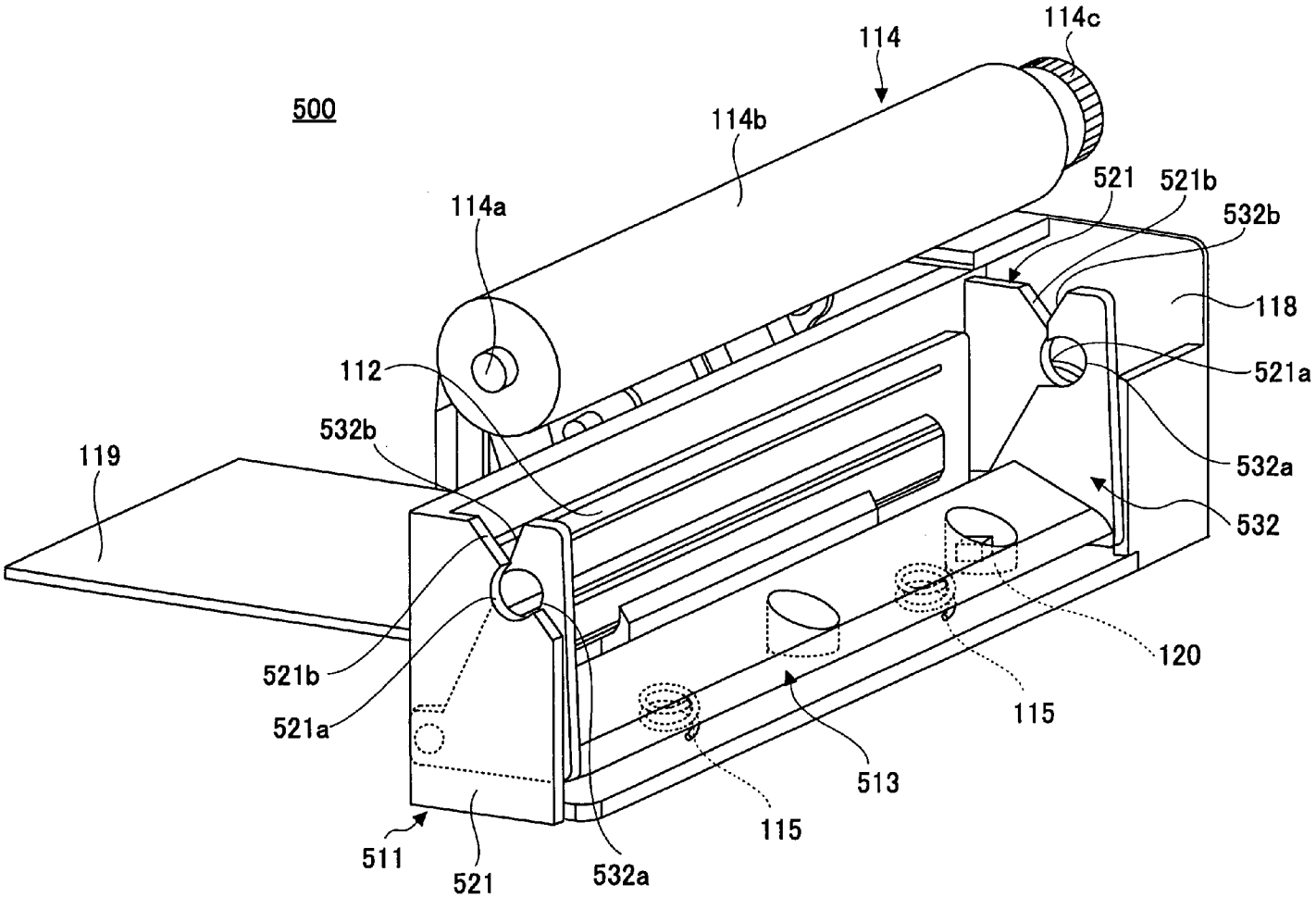
FIG. 22 shows a perspective view of a fifth embodiment of the present invention.

FIG. 22 shows a perspective view of a fifth embodiment of the present invention. In FIG. 22, the same reference numerals are given to parts/components the same as those of FIG. 1, and duplicate description is omitted.

A printing apparatus 500 in the fifth embodiment is different from the first embodiment in configurations of a frame 511 and a paper guide block 513. The frame 511 and the paper guide block 513 together hold the shaft 114*a* of the platen roller 114 in this embodiment.

[Frame 511]

Figure 23:
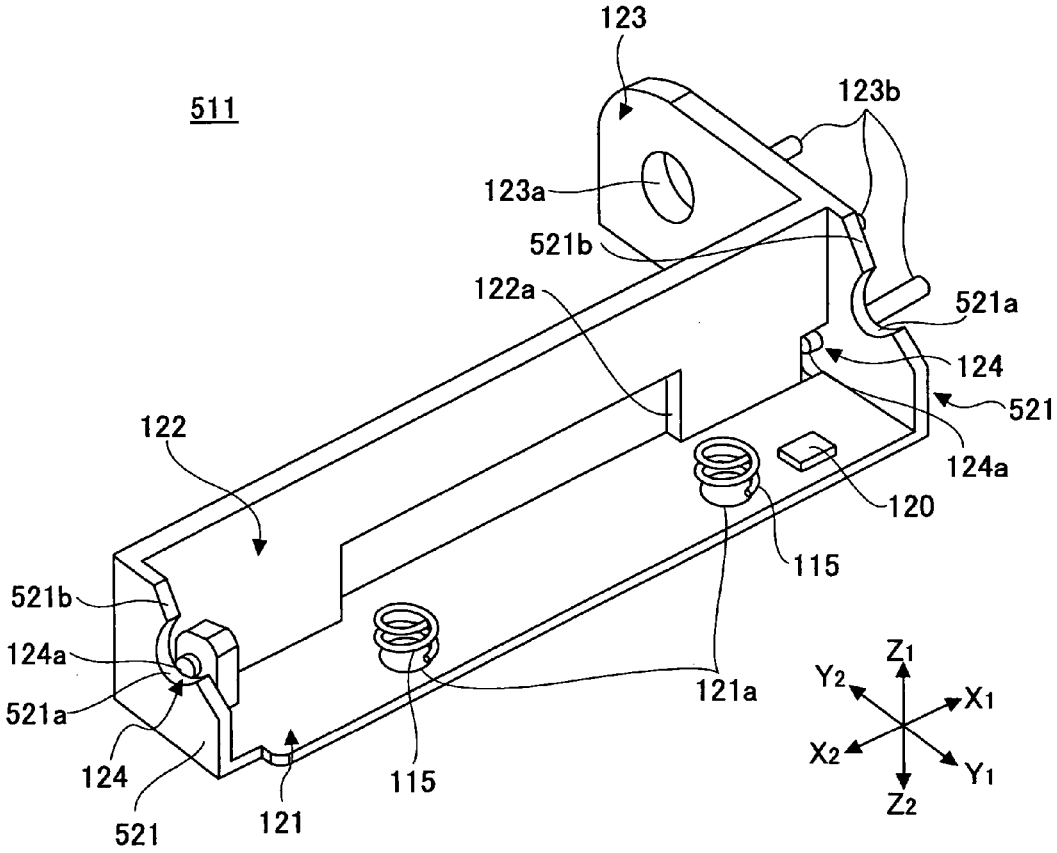
FIG. 23 shows a perspective view of a frame 511.

FIG. 23 shows a perspective view of the frame 511.

The frame 511 in the present embodiment is different from that of the first embodiment in that engaging parts 521 are provided on both ends in the arrow X1, X2 directions for engaging with the shaft 114*a* of the platen roller 114. In bearing parts 521, U-grooves 521*a* and guide parts 521*b* are formed.

Figure 24:
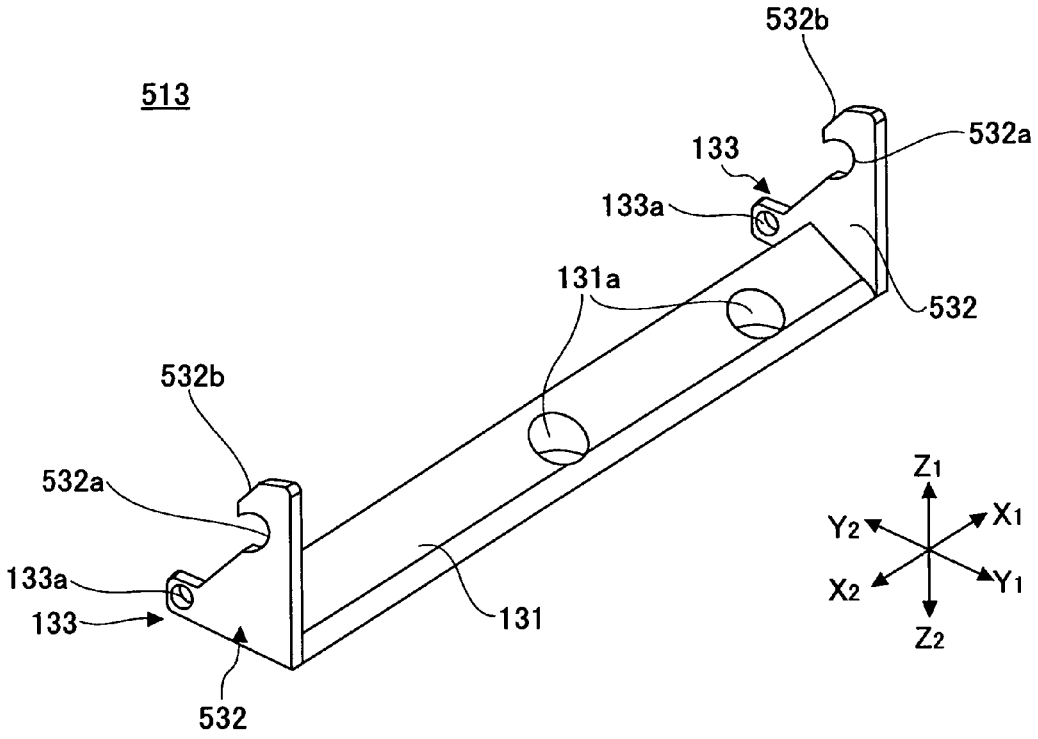
FIG. 24 shows a perspective view of a paper guide block 513.

FIG. 24 shows a perspective view of a paper guide block 513.

The paper guide block 513 in this embodiment is different from that of the first embodiment in that bearing parts 532 are provided. The bearing parts 532 have U-grooves 532*a* and guide parts 532*b*.

[Operation]

Figure 25:
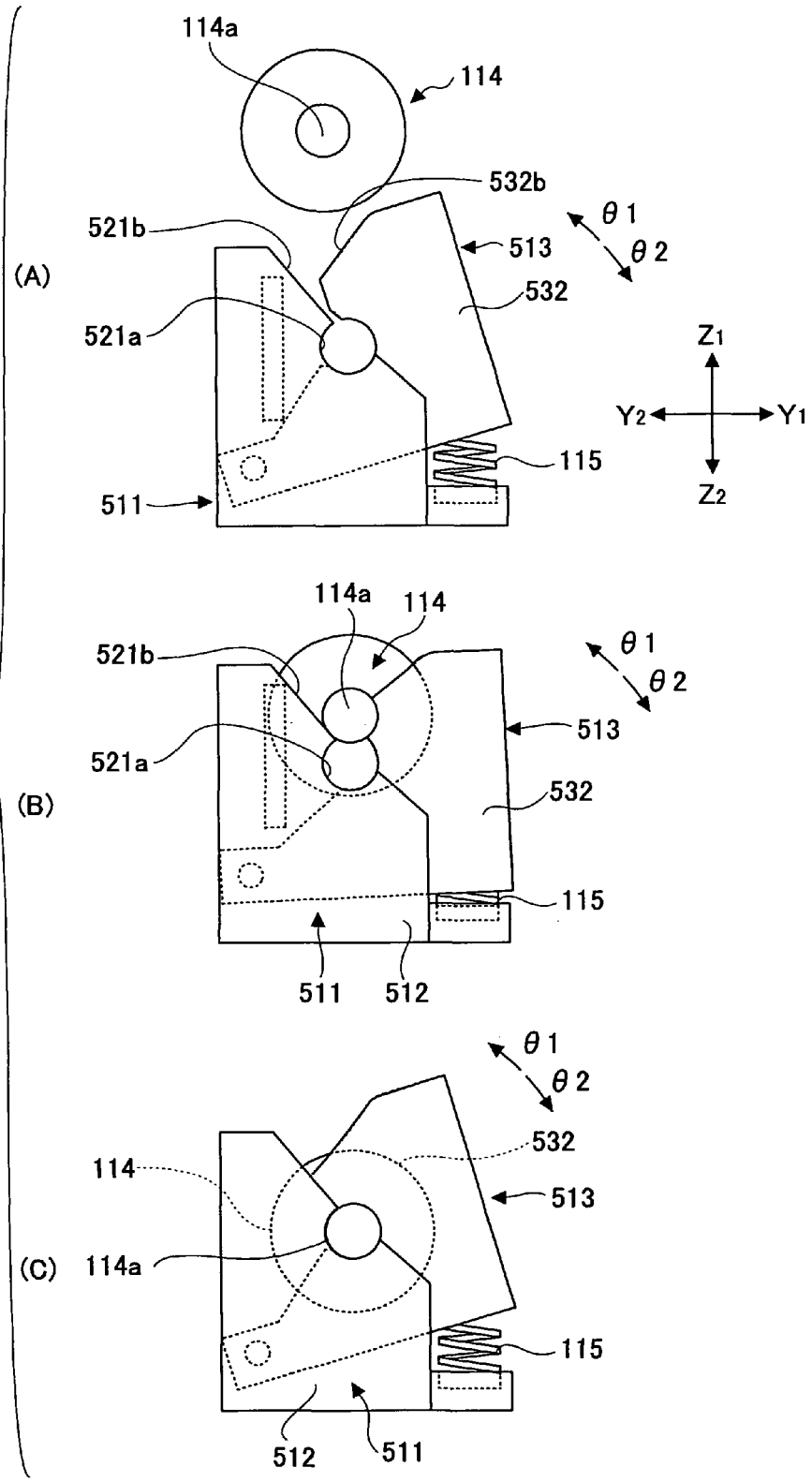
FIG. 25 illustrates operation of the fifth embodiment of the present invention.

FIG. 25 illustrates operation of the fifth embodiment.

When paper is to be loaded, as shown in FIG. 25(A), the platen roller 114 is to be removed from the paper guide block 513. In the state in which the platen roller 114 is thus removed from the paper guide block 513, the paper guide block 513 is in a state in which it rotates in the arrow θ1 direction.

The heat sensitive paper 141 is to be placed in the guide part 131 in this state as shown in FIG. 25(B). Next, as shown in FIG. 25(B), the rotating shaft 114*a* of the platen roller 114 is to be pressed in the arrow Z2 direction along the guide parts 521*b* and the guide-parts 523*b*. Thereby, as shown in FIG. 25(C), the paper guide block 513 rotates in the arrow θ2 direction against a resilient force of the coil springs 115, and is loaded between the U-grooves 521*a* and the U-grooves 532*a*.

At this time, the U-grooves 532*a* are formed in such a direction that, by means of friction of the heat sensitive paper as shown in FIG. 25(C), the rotating shaft 114*a* of the platen roller 114 can be positively held in a direction of a resultant force F3 of a force F1 applied to the platen roller 114 and a force F2 applied to the gear 114*c*.

Sixth Embodiment

Figure 26:
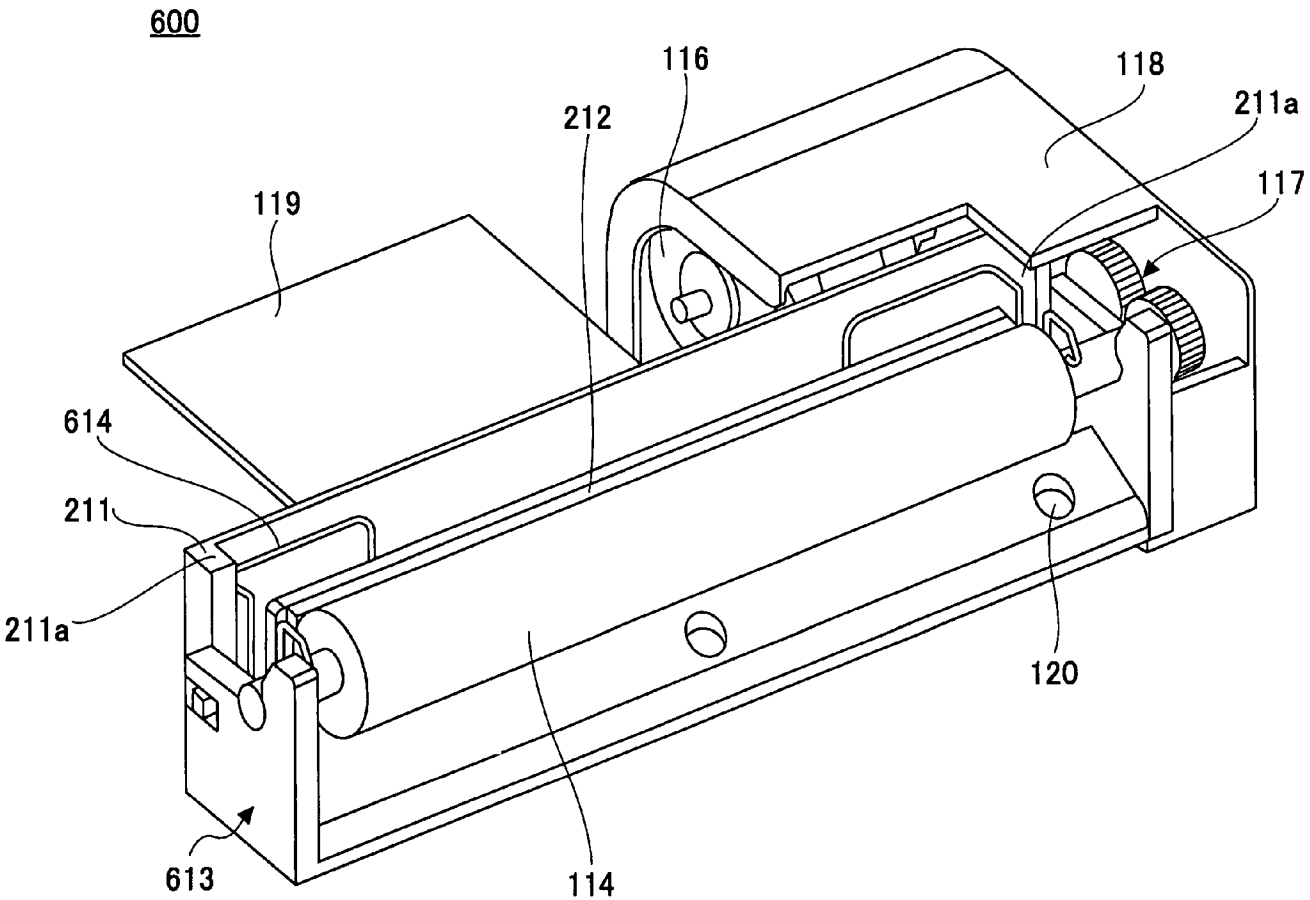
FIG. 26 shows a perspective view of a sixth embodiment of the present invention.

FIG. 26 shows a perspective view of a sixth embodiment of the present invention. In FIG. 26, the same reference numerals are given to parts/components the same as those of FIG. 7, and duplicate description is omitted.

A printing apparatus 600 in the sixth embodiment is different from the second embodiment in configurations of a paper guide block 613 and a rod spring 614. The paper guide block 613 and the rod spring 614 hold the rotating shaft 114*a* of the platen roller 114 in this embodiment.

Figure 27:
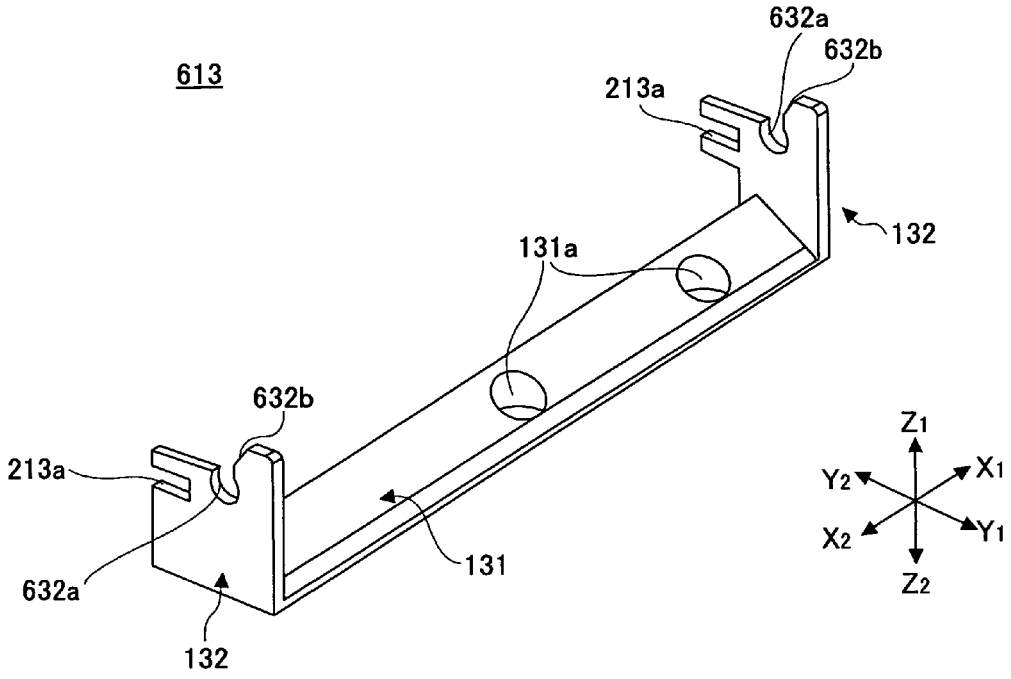
FIG. 27 shows a perspective view of a paper guide block 613.

FIG. 27 shows a perspective view of the paper guide block 613. In FIG. 27, the same reference numerals are given to parts/components the same as those of FIG. 7, and duplicate description is omitted.

The paper guide block 613 in this embodiment is different from that of the second embodiment in a configuration of bearings 632. The bearings 632 have U-grooves 632*a* and guide parts 632*b*.

Figure 28:
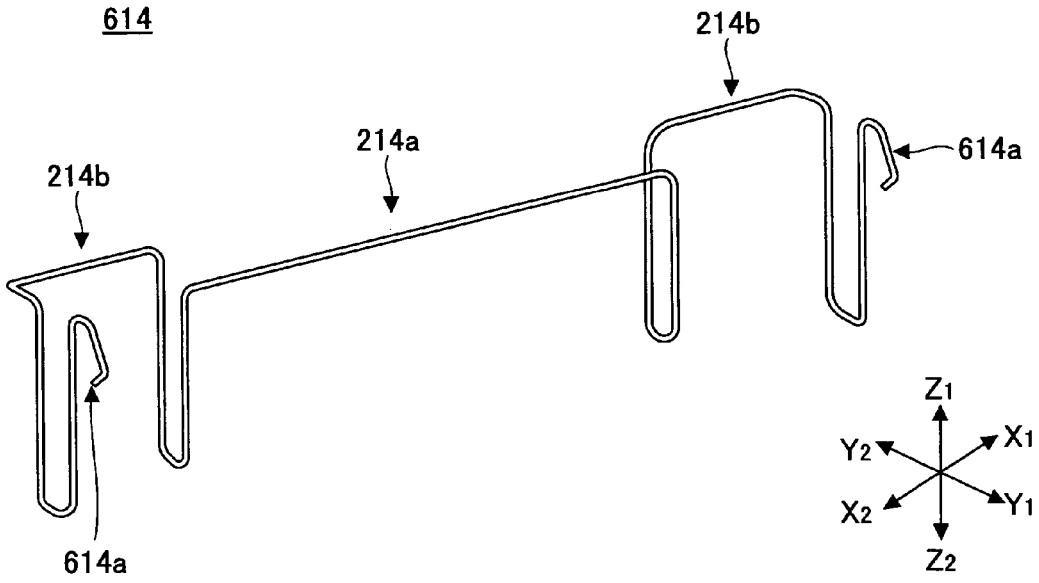
FIG. 28 shows a perspective view of a rod spring 614.

FIG. 28 shows a perspective view of the rod spring 614. In FIG. 28, the same reference numerals are given to parts/components the same as those of FIG. 8, and duplicate description is omitted.

In the rod spring 614, instead of the contacting part, claw parts 614*a* are provided. The claw parts 614*a* engage with the rotating shaft 114*a* of the platen roller 114, so as to press the rotating shaft 614*a* of the platen roller 114 onto the U-grooves 632*a* provided in the bearings 632 of the paper guide block 613.

[Operation]

Figure 29:
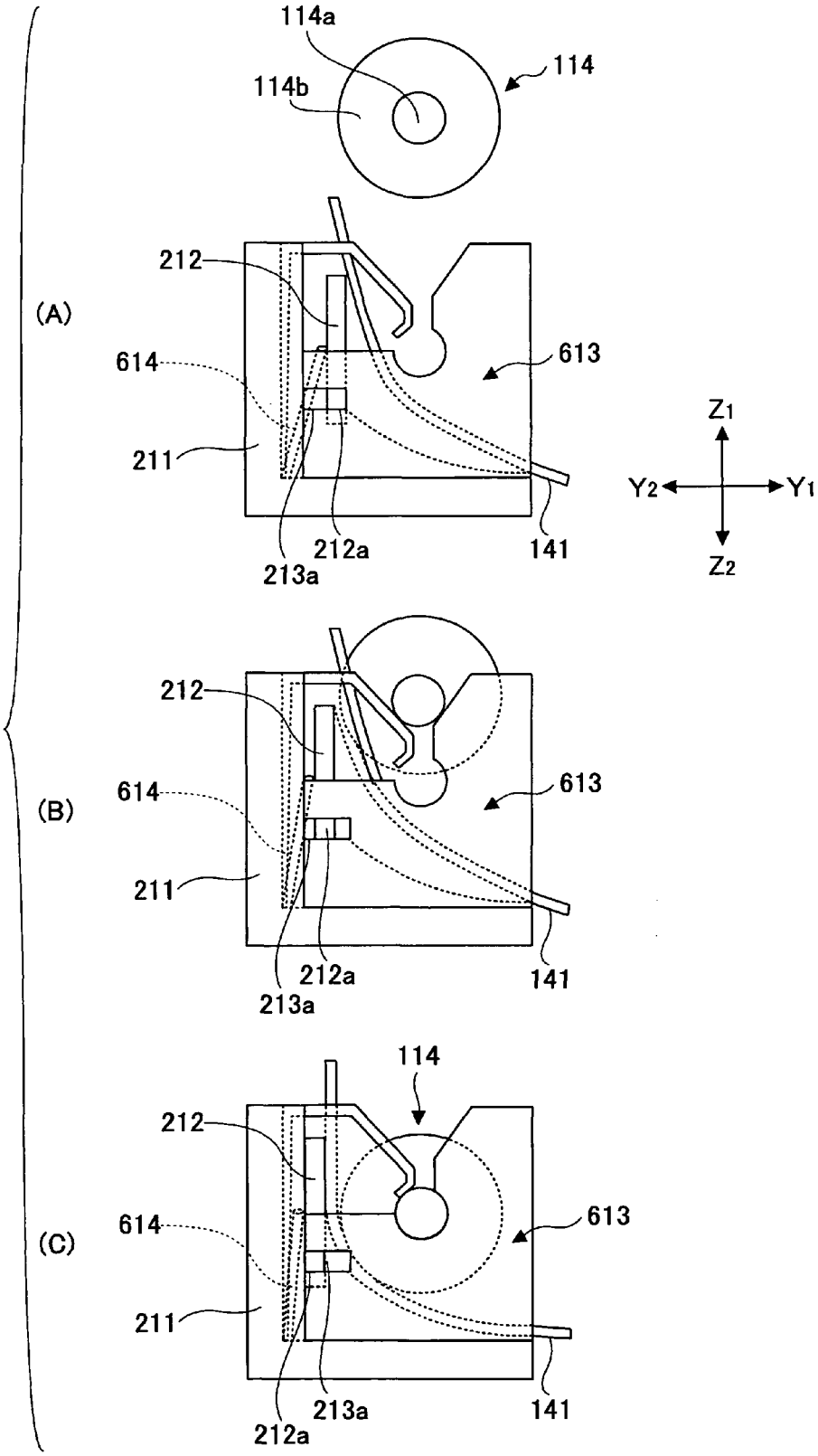
FIG. 29 illustrates operation of the sixth embodiment of the present invention.

FIG. 29 illustrates operation of the sixth embodiment.

When paper is to be loaded, as shown in FIG. 29(A), the platen roller 114 is to be removed from the paper guide block 613. When the platen roller 114 is thus removed from the paper guide block 613, the paper guide block 613 is in a state in which it rotates in the arrow θ1 direction.

In this state, as shown in FIG. 29 (B), the heat sensitive paper 141 is to be placed on the paper guide part 131 of the paper guide block 613. Next, as shown in FIG. 29 (B), the rotating shaft 114*a* of the platen roller 114 is to be pressed in the arrow Z2 direction along the claw parts 614*a* and the guide parts 632*b*. Thereby, as shown in FIG. 29 (C), the claw parts 614*a* are elastically pressed in the arrow Y2 direction, and the rotating shaft 114*a* of the platen roller 114 is loaded in the U-grooves 632*a*. When the rotating shaft 114*a* of the platen roller 114 is thus pressed in the U-grooves 632*a*, the claw parts 614*a* return in the arrow Y1 direction, the rotating shaft 114*a* of the platen roller 114 is pressed thereby into the U-grooves 632*a*, and thus, the platen roller 114 is rotatably held there.

[Others]

In each of the above-mentioned embodiments, the paper guide block and the gear cover are configured in separate bodies. However, in each of the second through fourth embodiments, the paper guide block is fixed to the frame. Accordingly, the paper guide block and the gear cover may be integrally formed.

Further, in the above-mentioned embodiments, it is possible to save space, in particular, to reduce a space in the arrow Y1, Y2 directions, and thus, it is possible to create a space between the frame 111 and the motor 116 for example. Thereby, it is possible to hold a card reader or such there, and thus, it is possible to create a multi-function apparatus.

Seventh Embodiment

Figure 30:
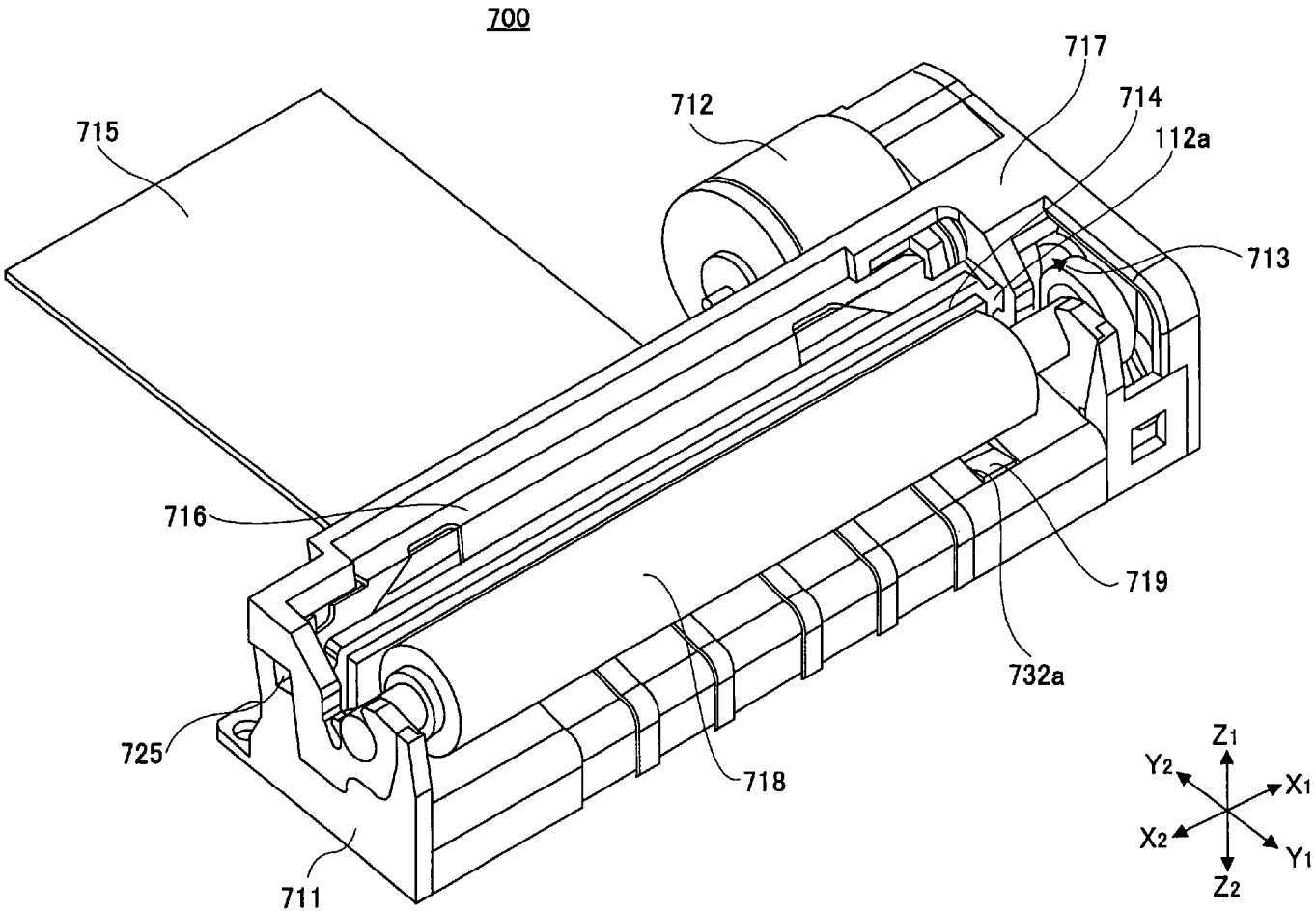
FIG. 30 shows a front perspective view of a seventh embodiment of the present invention.
Figure 31:
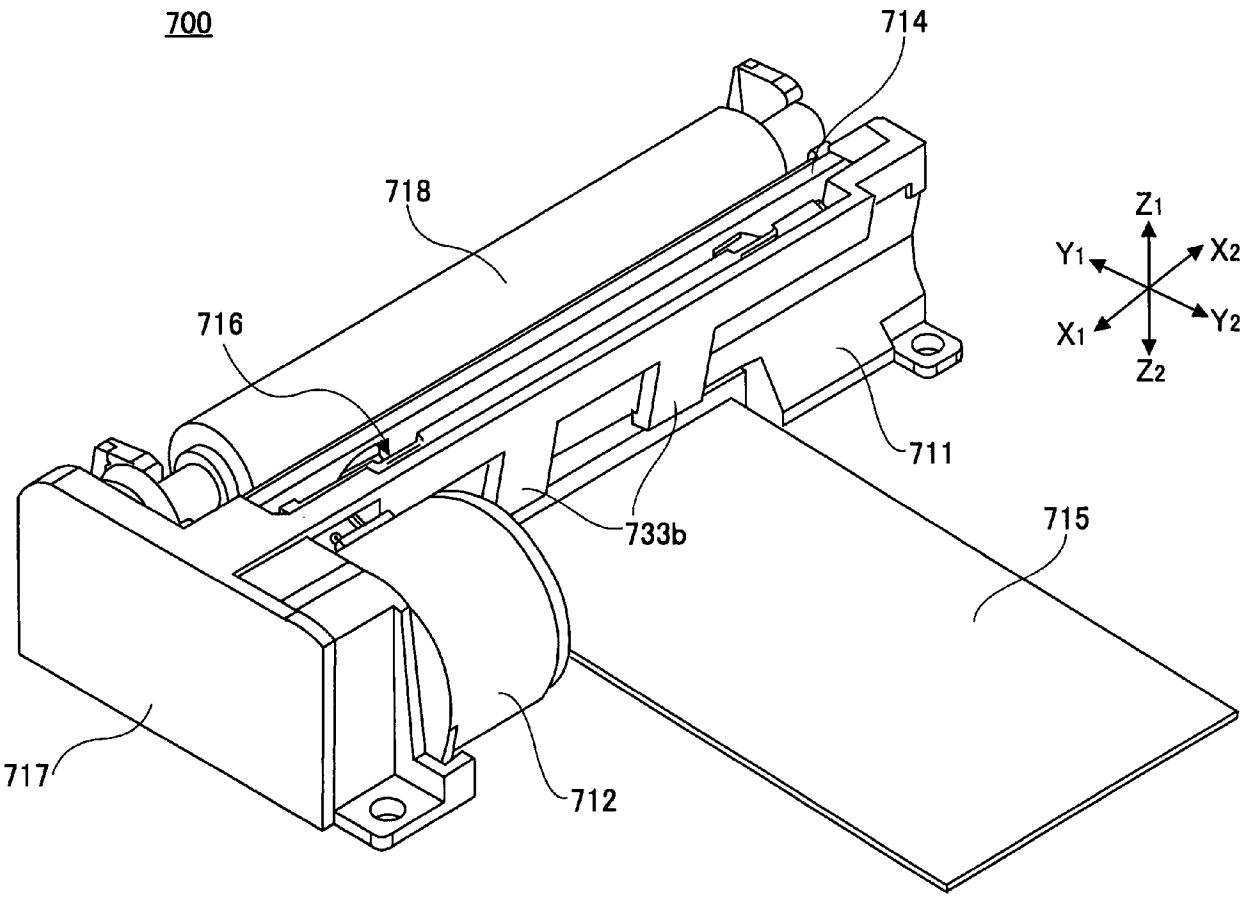
FIG. 31 shows a rear perspective view of the seventh embodiment of the present invention.
Figure 32:
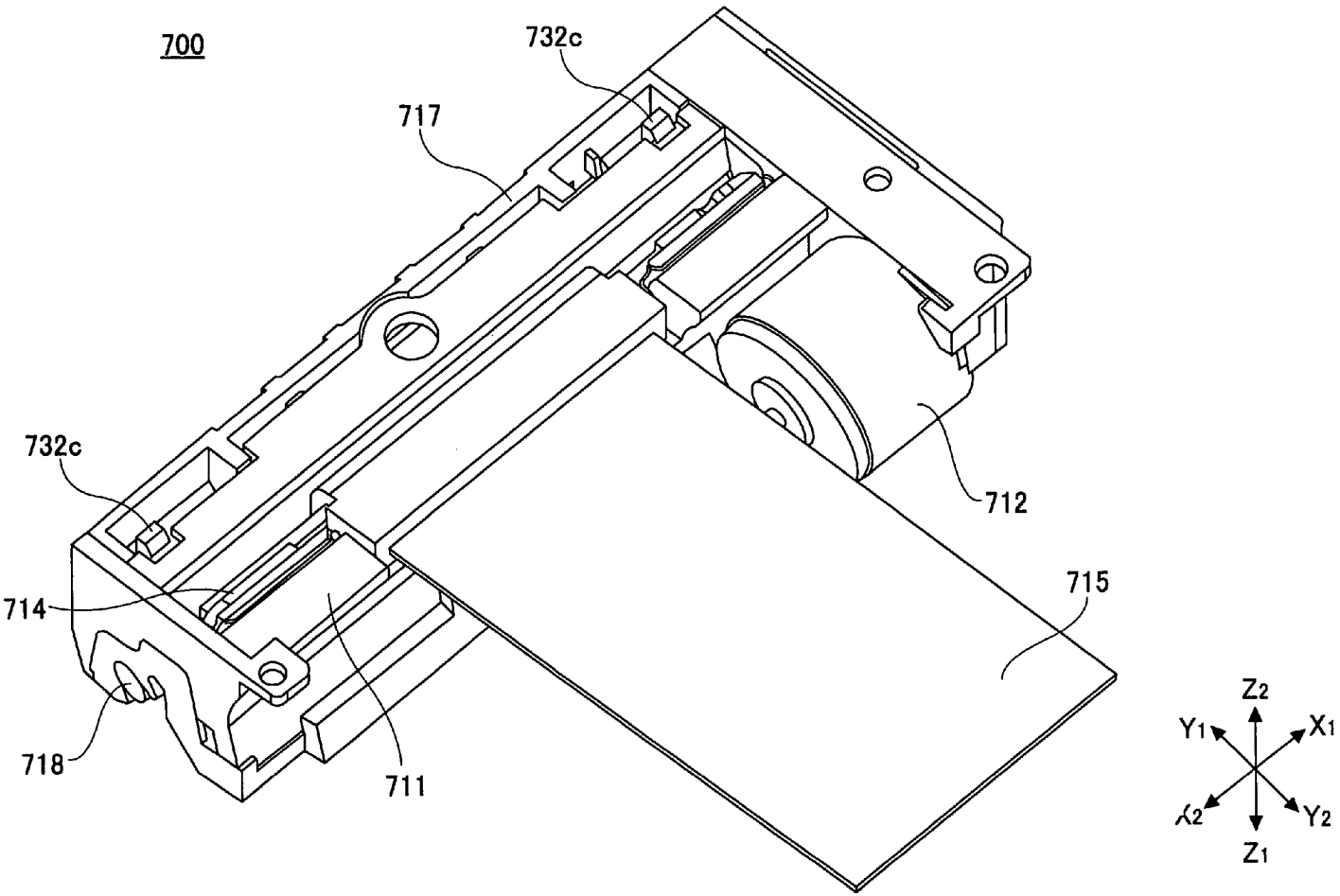
FIG. 32 shows a bottom perspective view of the seventh embodiment of the present invention.
Figure 33:
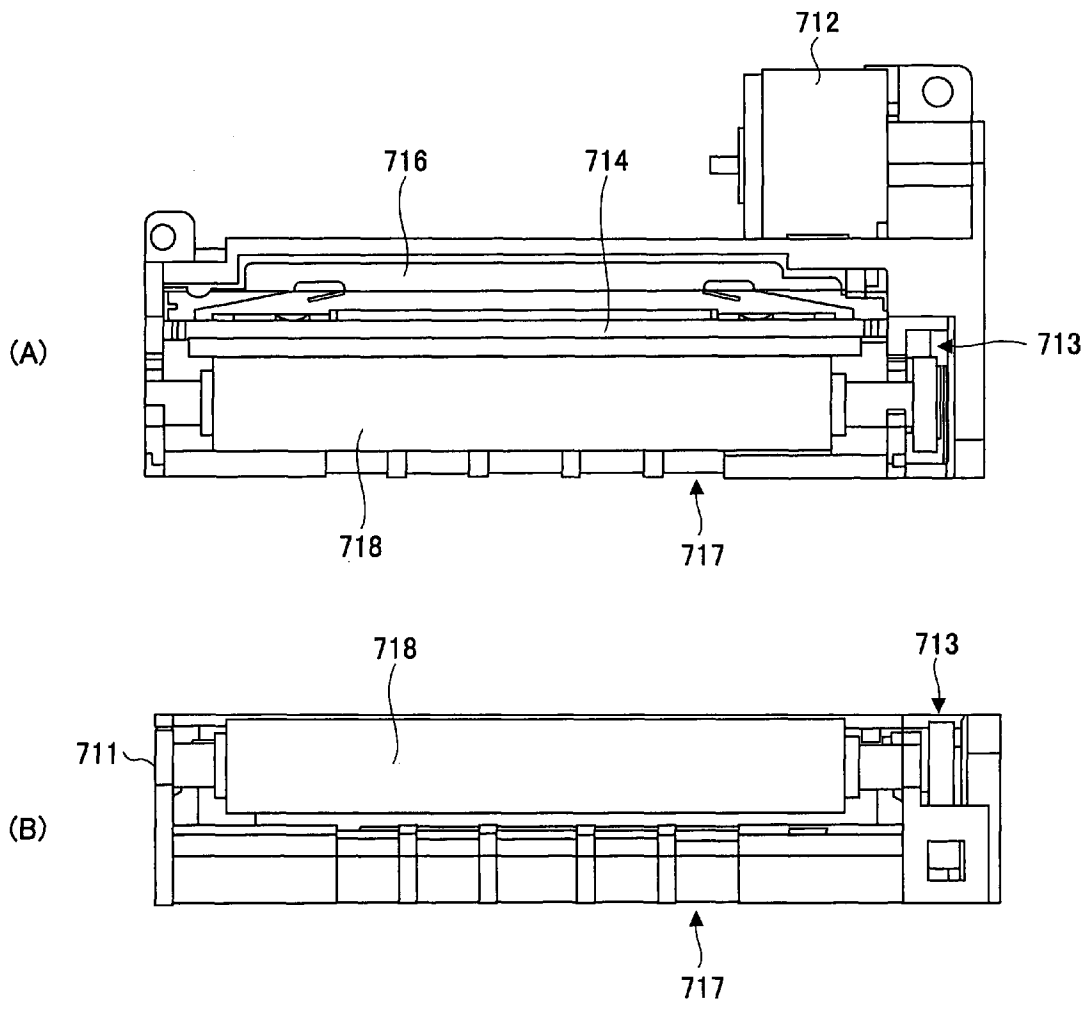
FIG. 33 shows a plan view of the seventh embodiment of the present invention.
Figure 34:
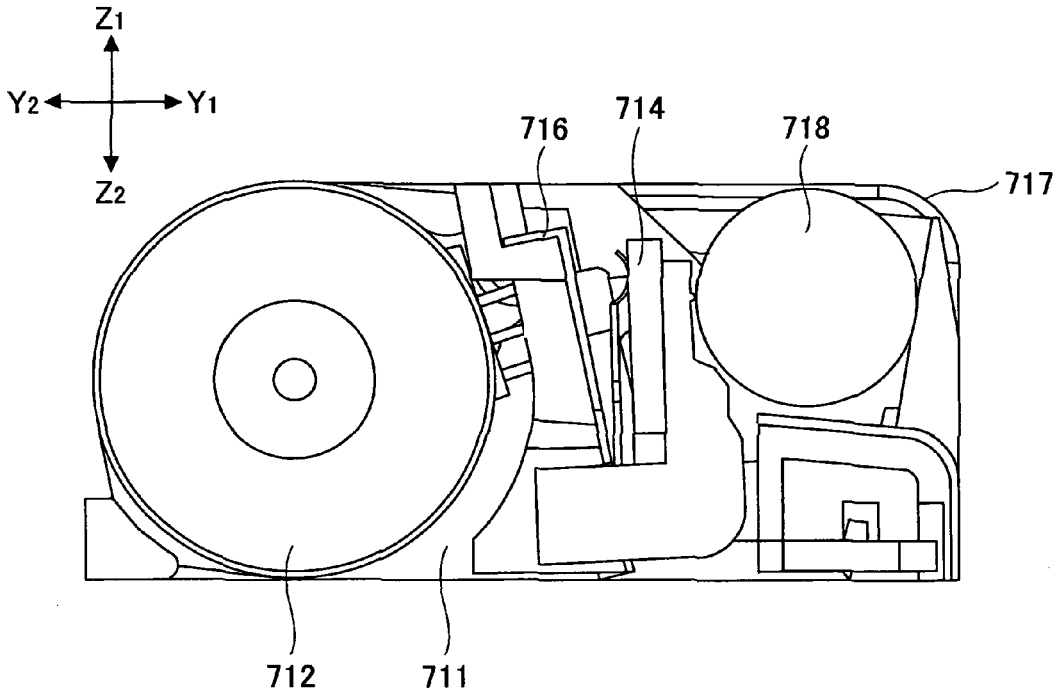
FIG. 34 shows a sectional view of a relevant part of the seventh embodiment of the present invention.

FIG. 30 shows a front perspective view of a seventh embodiment of the present invention; FIG. 31 shows a rear perspective view of the seventh embodiment of the present invention; FIG. 32 shows a bottom perspective view of the seventh embodiment of the present invention; FIG. 33 shows a plan perspective view of the seventh embodiment of the present invention; and FIG. 34 shows a sectional view of the seventh embodiment of the present invention.

A printing apparatus 700 in the seventh the embodiment includes a base frame 711, a motor 712, a reduction gear mechanism 713, a printing head 714, an FPC cable 715, a pressing spring 716, a paper guide block 717, a platen roller 718, a sensor 719 and so forth. It is noted that the printing head 714 has the same configuration as that of the printing head 212 shown in FIG. 9.

[Base Frame]

Figure 35:
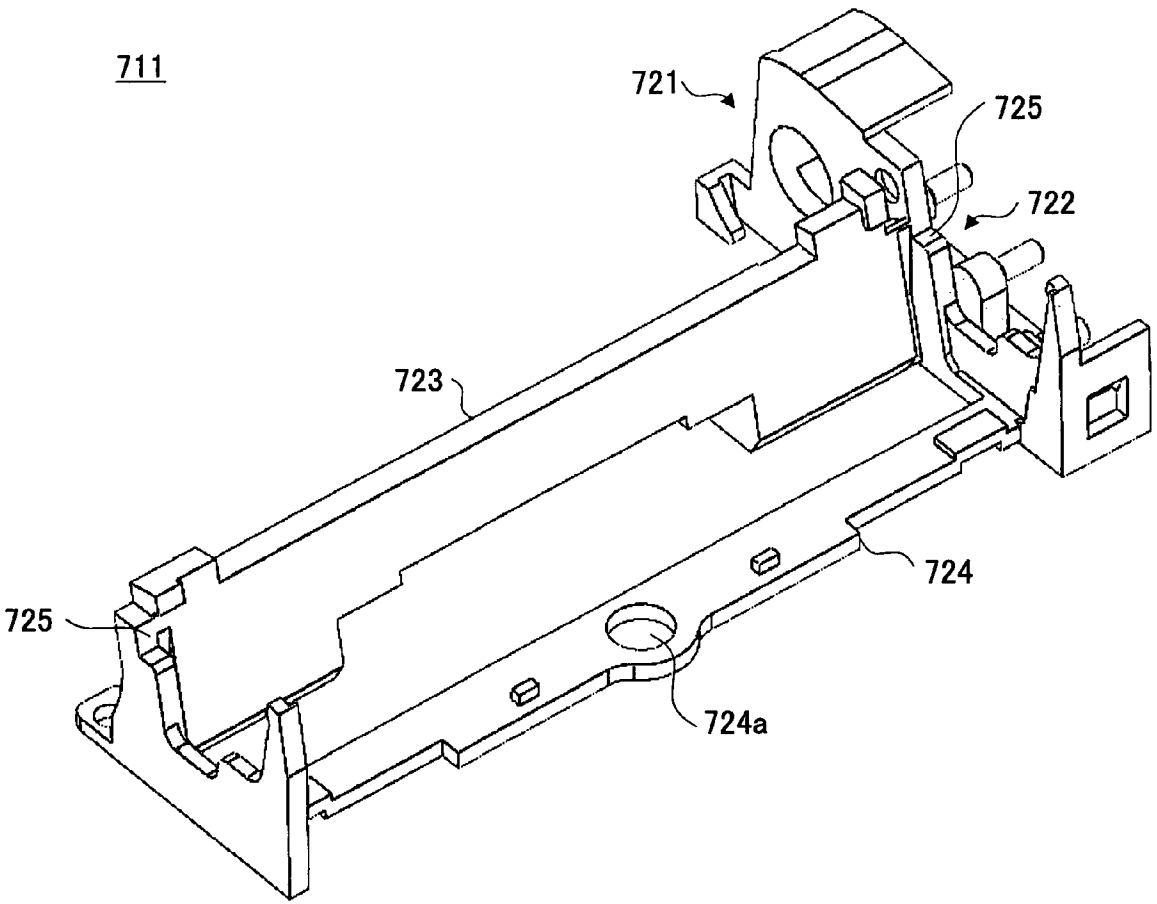
FIG. 35 shows a front perspective view of a base frame 711.
Figure 36:
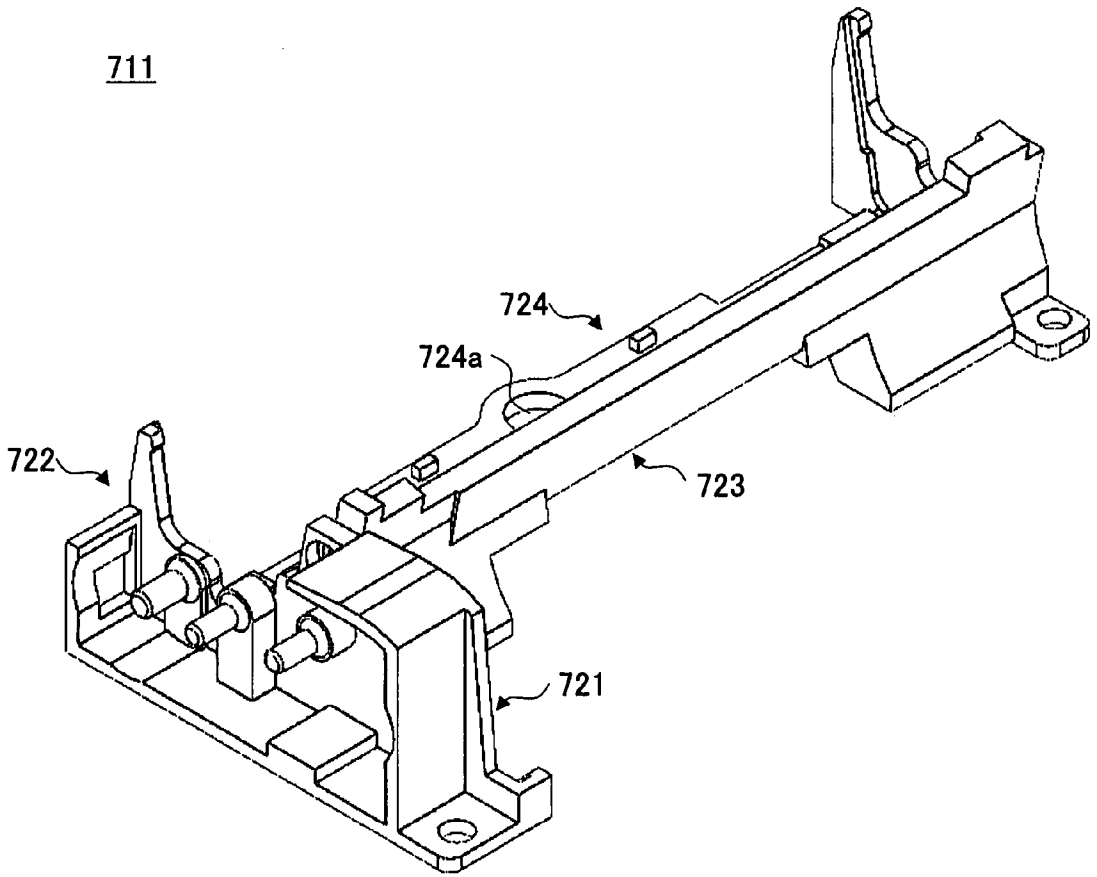
FIG. 36 shows a rear perspective view of the base frame 711.
Figure 37:
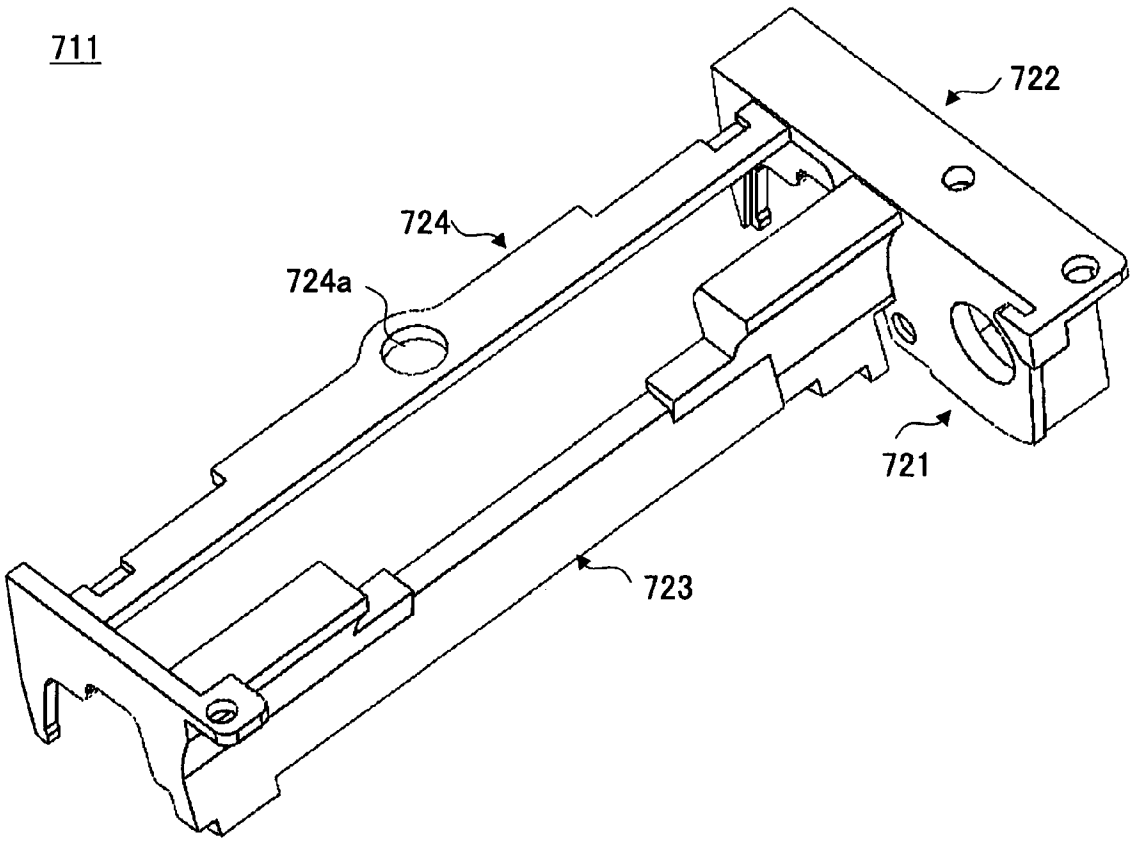
FIG. 37 shows a bottom perspective view of the base frame 711.

FIG. 35 shows a front perspective view of the base frame 711; FIG. 36 shows a rear perspective view of the base frame 711; and FIG. 37 shows a bottom perspective view of the base frame 711.

The base frame 711 has a configuration such that a motor mounting part 721, a reduction gear mechanism mounting part 722, a pressing spring mounting part 723, a paper guide block mounting part 724 and a printing head retreating part 725 are integrally formed in a die-cast molding manner.

In the motor mounting part 721, the motor 721 is mounted. In the reduction gear mechanism mounting part 722, gears included in the reduction gear mechanism 713 are loaded. The pressing spring mounting part 723 is located on a bottom side of the printing head 714, and therein, the pressing spring 716 pressing the printing head 714 in the direction of the platen roller 18 is loaded.

The paper guide block mounting part 724 is engaged with by the paper guide block 717, and is used for mounting the base frame 711 between the paper guide block 717. In the paper guide block mounting part 724, a mounting hole 724*a* is formed. In the mounting hold 724*a*, a screw is inserted when the apparatus is mounted on a to-be-mounted part.

The motor 712 is mounted to the motor mounting part 721, the gears of the reduction gear mechanism 713 are mounted to the reduction gear mechanism mounting part 722, and thus, the motor 712 engages with the reduction gear mechanism 713.

The printing head retreating part 725 is formed at a part with which the paper guide block 717 engages, and is used for retreating so that, when the paper guide block 717 is mounted to the base frame 711, the projection parts 112*a* of the printing head 714 are prevented from being held between the paper guide block 717 and the base frame 711. With the provision of the printing head retreating part 725, assembling can be made easily.

[Paper Guide Block 717]

Figure 38:
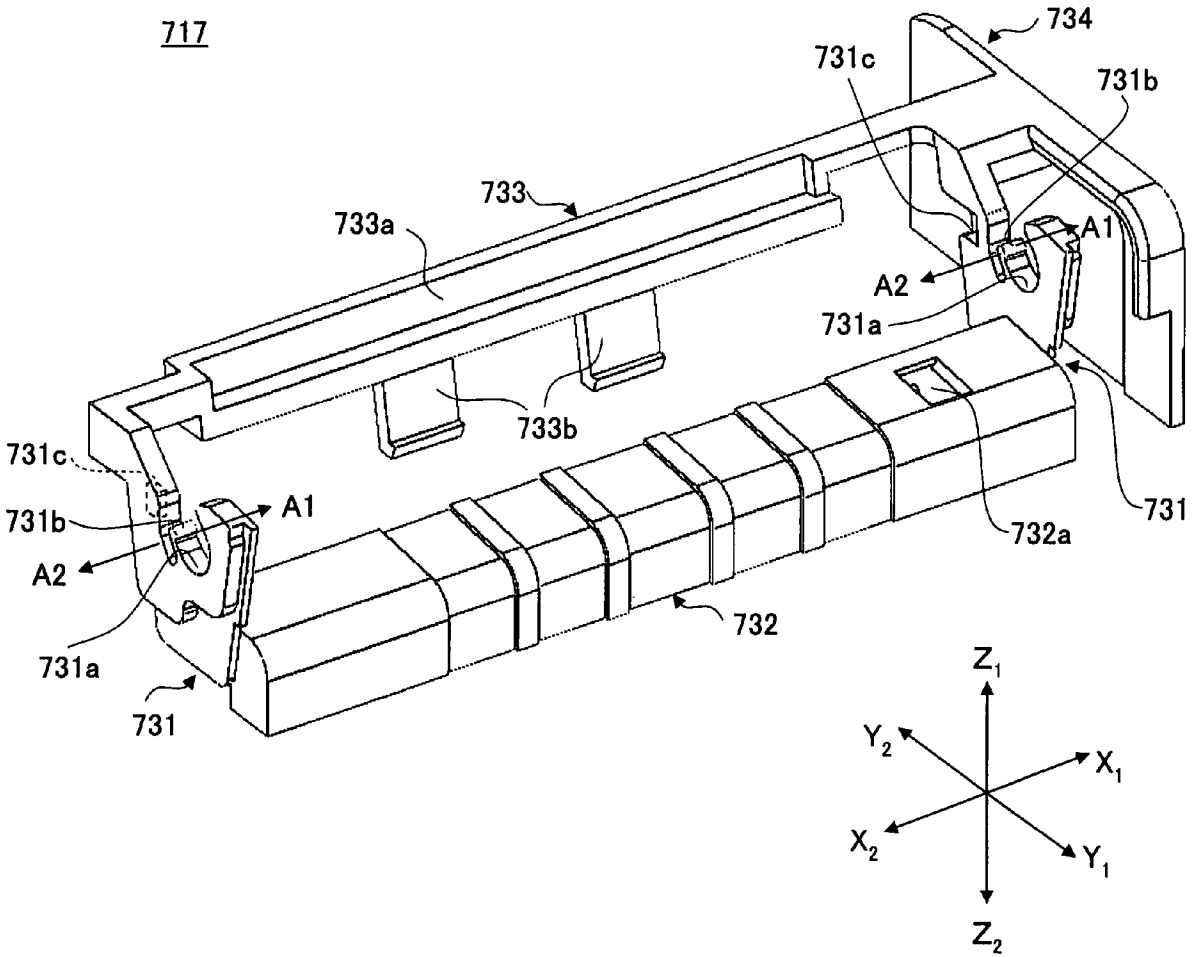
FIG. 38 shows a front perspective view of a paper guide block 717.
Figure 39:
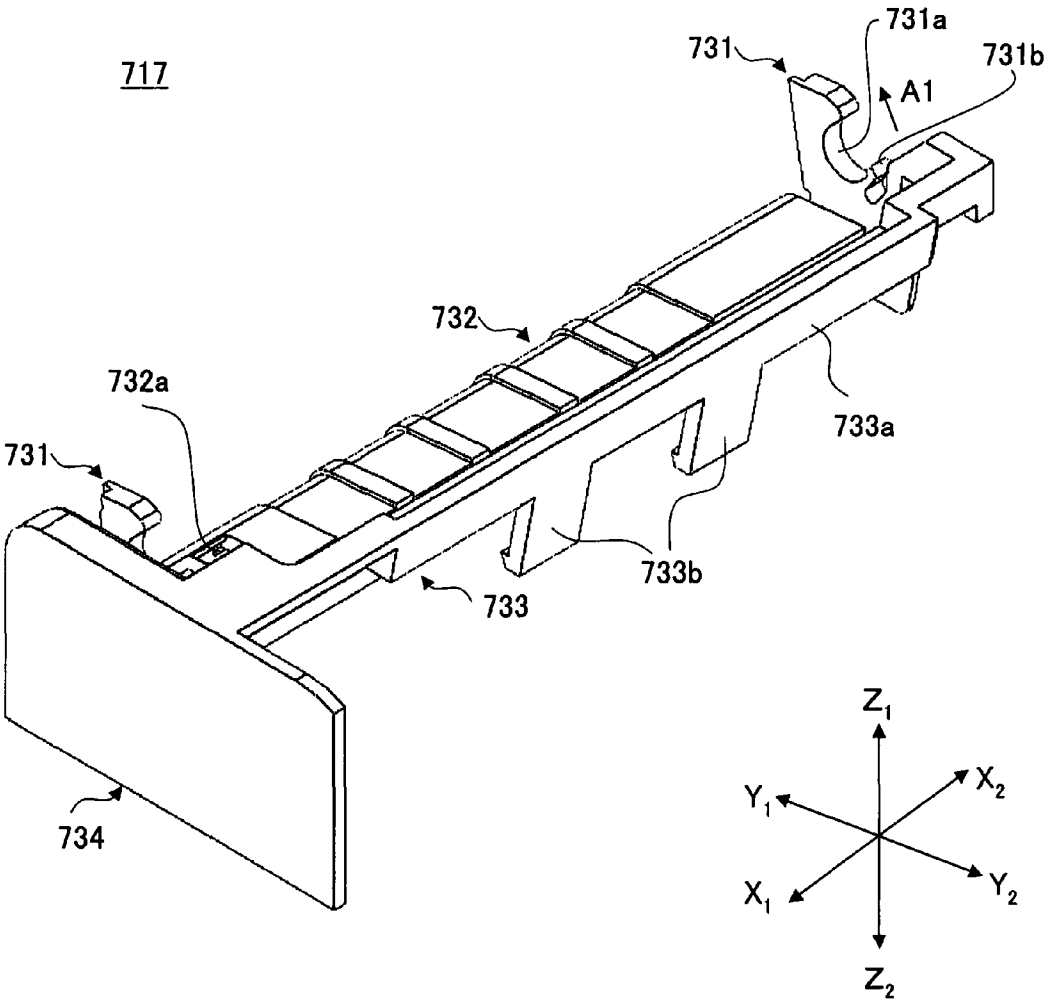
FIG. 39 shows a rear perspective view of the paper guide block 717.
Figure 40:
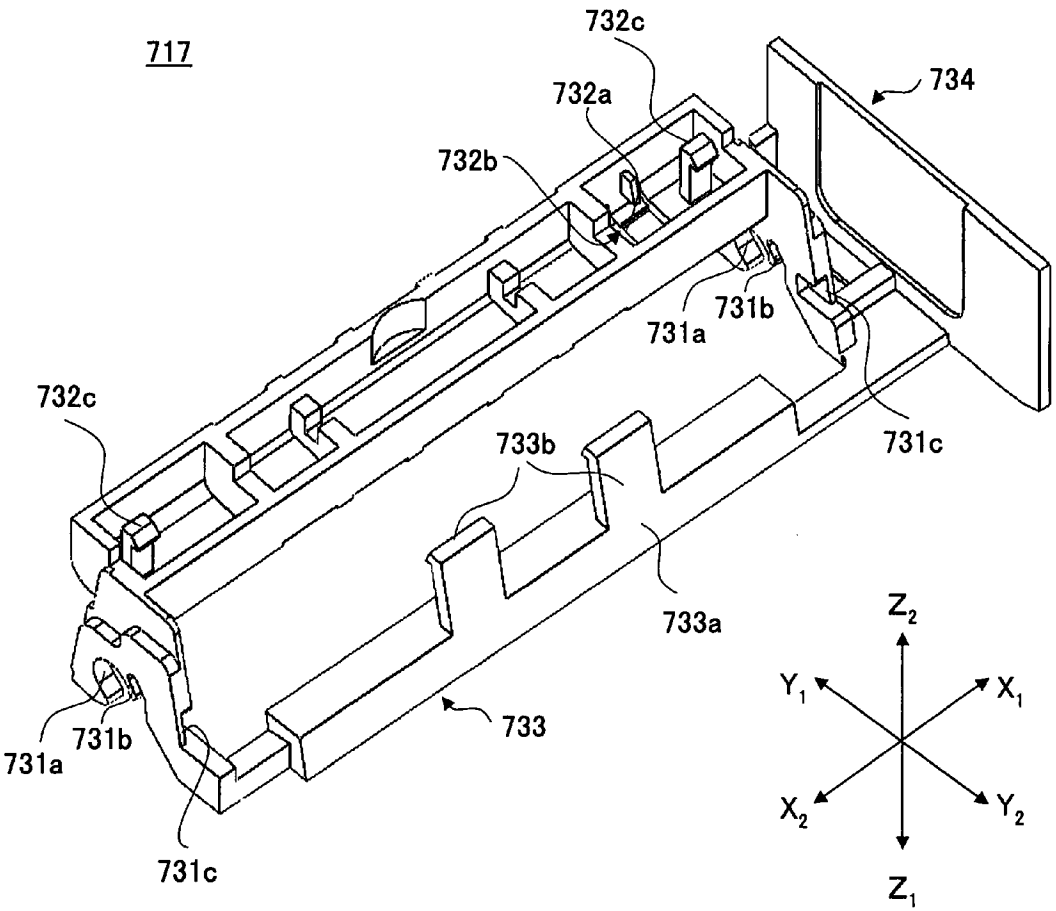
FIG. 40 shows a bottom perspective view of the paper guide block 717.

FIG. 38 shows a front perspective view of the paper guide block 717; FIG. 39 shows a rear perspective view of the paper guide block 717; and FIG. 40 shows a bottom perspective view of the paper guide block 717.

The paper guide block 717 is produced by a resin material molding manner. The paper guide block 717 includes platen roller bearing parts 731, paper guide part 732, an engaging part 733 and a gear cover part 734. Thereto, the printing head 714 and the platen roller 718 are loaded.

The platen roller bearing parts 731 are provided on the arrow X1, X2 direction ends, and rotatably hold the platen roller 718. The platen roller bearing parts 731 include bearings 731*a* and claw parts 731*b*, and further, printing head guide parts 731*c*.

The bearings 731*a* are formed in approximately U-shapes, and rotatably hold the rotating shaft of the platen roller 718. The claw parts 731*b* are formed in arrow A1, A2 directions elastically and deformably, and, when the shaft of the platen roller 718 is loaded in the bearings 731*a*, they are deformed in the arrow A1 direction, after that, return in the arrow A1 direction, and they press the rotating shaft of the platen roller 718 to the bearings 713*a*. By this configuration, the platen roller 718 can be easily mounted/removed to/from the paper guide block 717. Thus, replacement of paper can be easily made.

The printing head guide parts 731*c* are formed in such a manner as to be able to communicate with the printing head retreating parts 725, and engage with the projection parts 112*a* of the printing head 714. The projection parts 112*a* of the printing head 714 engage with the printing head guide parts 713*c* and the printing head 714 is positioned swingably with respect to the platen roller 718

The paper guide part 732 is placed horizontally on the arrow Z2 direction side of the platen roller bearing parts 731 along the arrow X1, X2 directions, and functions to guide the paper inserted from the arrow Y1 direction when the paper passes between the platen roller 718 and the printing head 714 in a curled manner.

In the paper guide part 732, through holes 732*a*, substrate holding parts 732*b* and engaging claw parts 732*c* are formed. A sensor for detecting existence/absence of paper and the platen roller 718, is disposed on the bottom side of the through holes 732*a*, i.e., on the surface on the arrow Z2 direction side. The sensor detects existence/absence of paper and the platen roller 718 through the through holes 732*a*.

Figure 41:
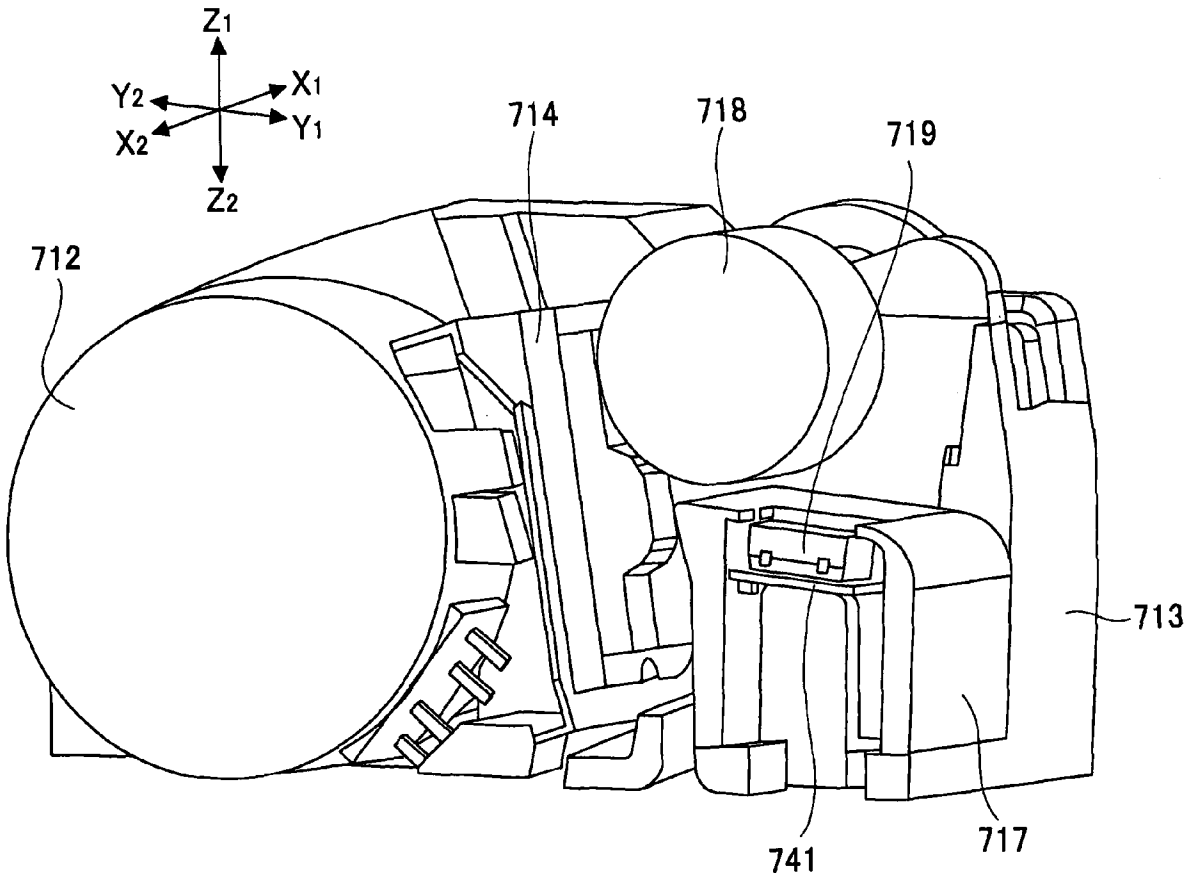
FIG. 41 shows a sectional view of a relevant part of the seventh embodiment of the present invention.

FIG. 41 shows a sectional perspective view of a relevant part of the seventh embodiment.

On the substrate holding parts 732*b*, a sensor substrate 741 on which the sensor 719 is mounted is held. The engaging claw parts 732*c* engage with the arrow Y1 direction side of the arrow Z2 direction end part of the paper guide block mounting part 724 of the base frame 711.

The engaging part 733 includes a vertically placing part 733*a* and engaging claw parts 733*b*. The vertically placing part 733*a* is vertically placed on the arrow Z1 direction end of the arrow Y2 direction end side of the platen roller bearing parts 731 along the arrow X1, X2 directions. The engaging claw parts 733*b* extend in the arrow Z2 direction, and engage with the arrow Y2 direction side of the arrow Z2 direction end side of the printing head mounting part 723 of the base frame 711. Thereby, the paper guide block 717 hold the base frame 711 by means of the engaging claw parts 732*c*, 733*b*, and is mounted on the base frame 711.

The gear cover 734 is disposed on the arrow X1 direction side of the reduction gear mechanism 713, and avoids removal of the gears of the reduction gear mechanism 713 in the arrow X1 direction.

[Advantage]

In the seventh embodiment, the platen roller bearing parts 731 for rotatably holding the platen roller 718 in the paper guide block 717 and the printing head guide parts 731*c* for positioning the printing head 714 are formed integrally. Thereby, the paper guide block 717 positions the platen roller 718 and the printing head 714. Accordingly, even when a shape of the paper guide block 717 is changed, the common base frame 711 can be applied, and thus, the common base frame 711 can be applied to various types.

First Variant Embodiment

Figure 42:
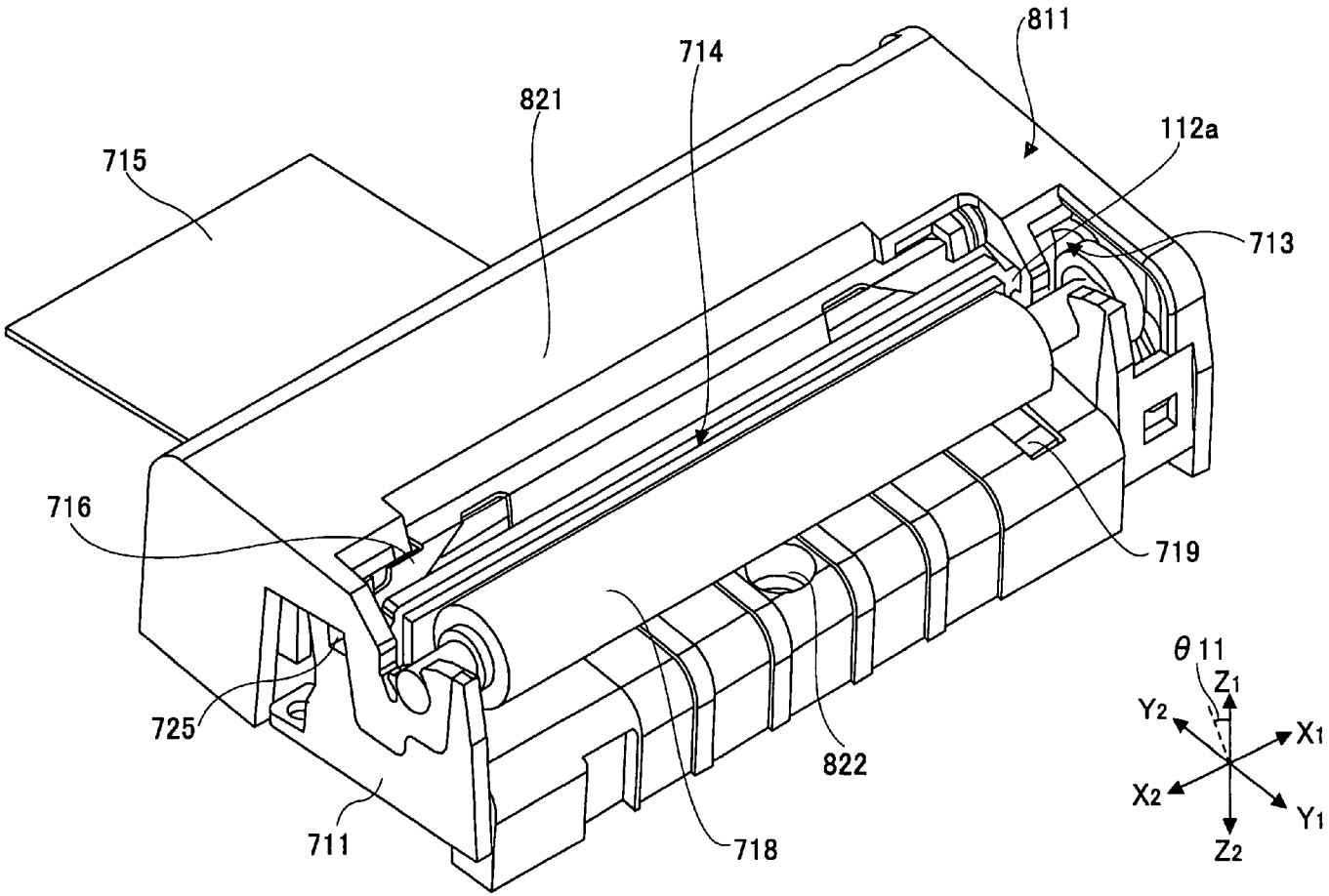
FIG. 42 shows a front perspective view of a first variant embodiment of the seventh embodiment of the present invention.
Figure 43:
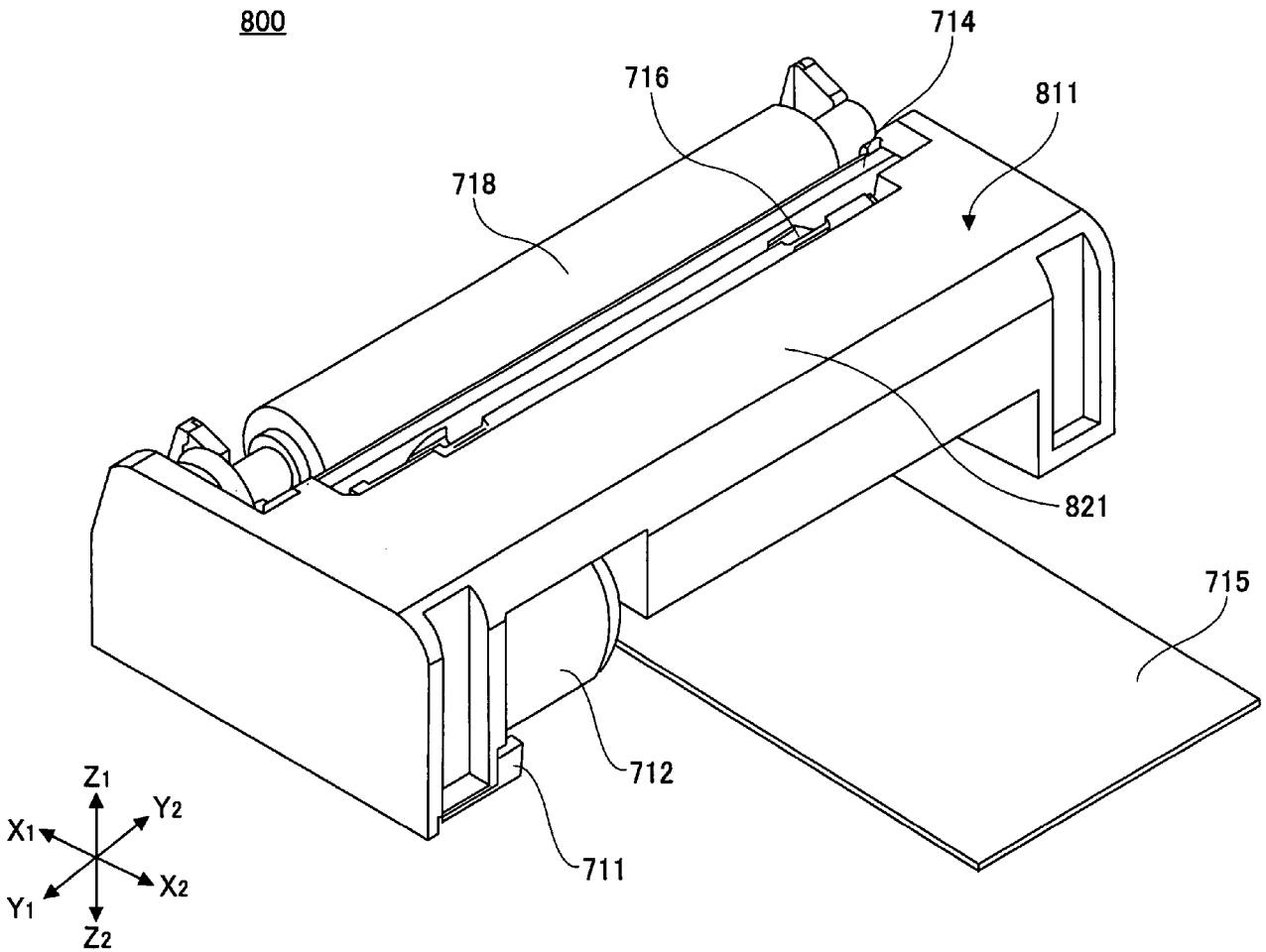
FIG. 43 shows a rear perspective view of the first variant embodiment of the seventh embodiment of the present invention.
Figure 44:
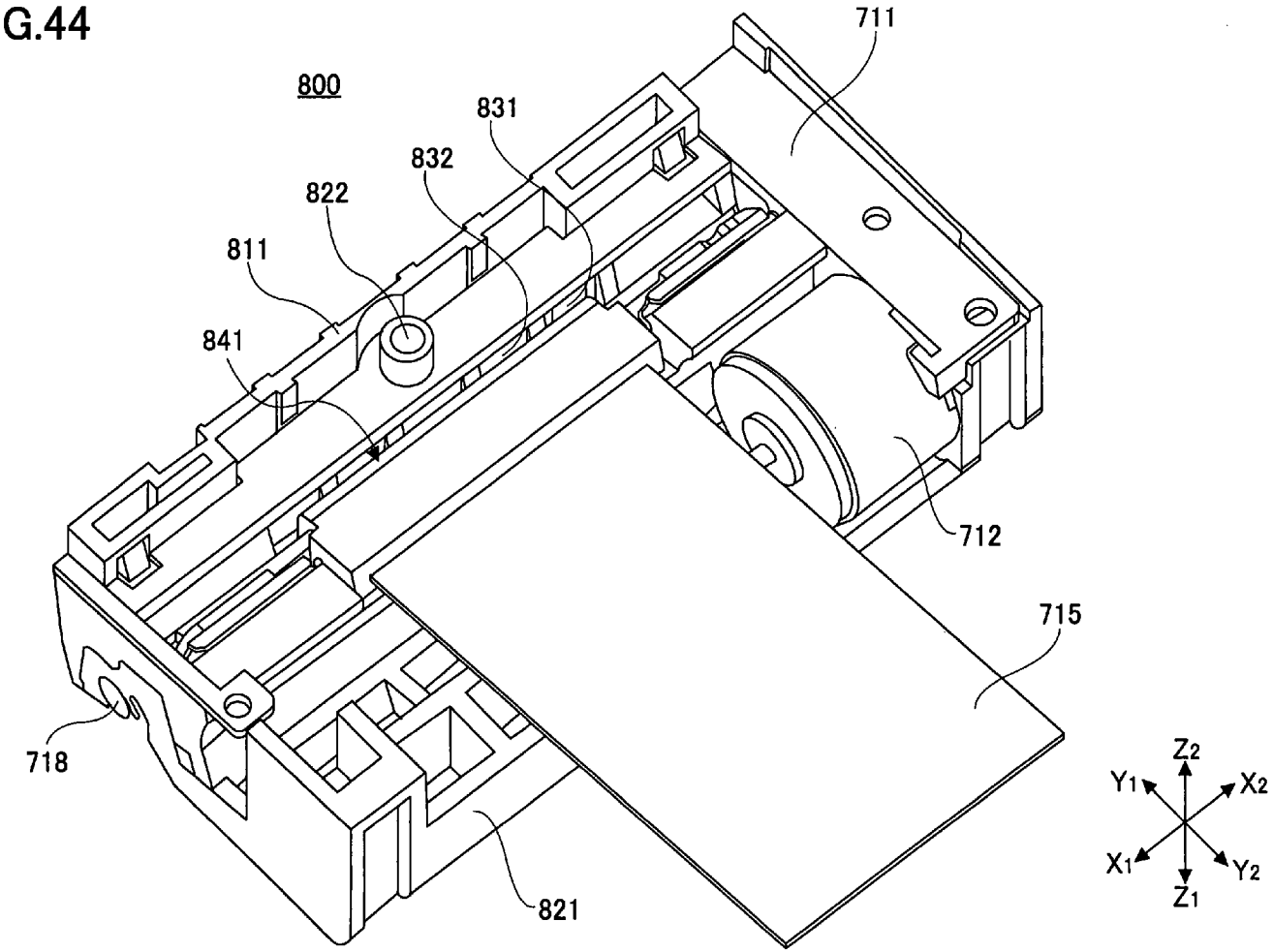
FIG. 44 shows a bottom perspective view of the first variant embodiment of the seventh embodiment of the present invention.
Figure 45:
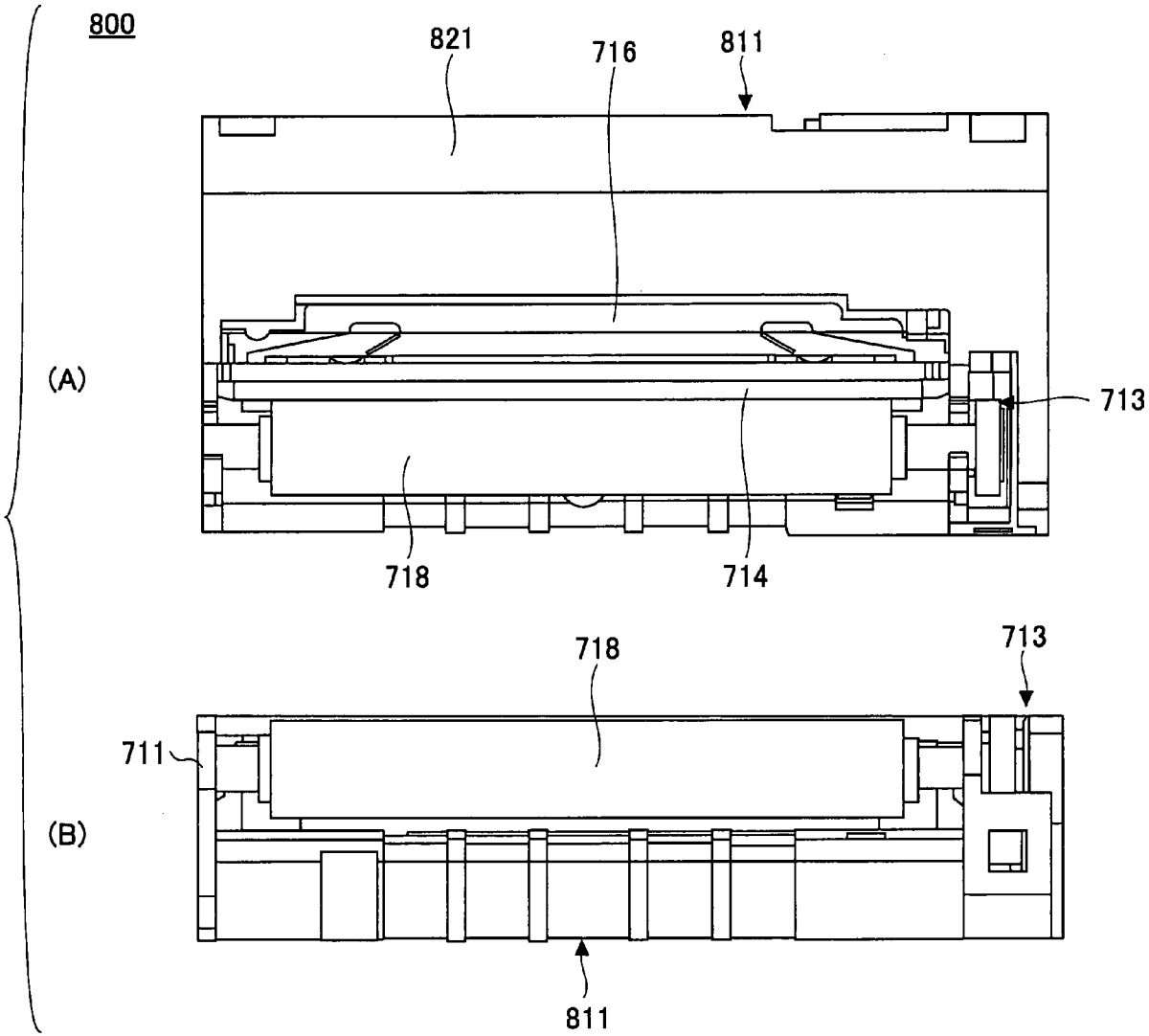
FIG. 45 shows a plan view of the first variant embodiment of the seventh embodiment of the present invention.
Figure 46:
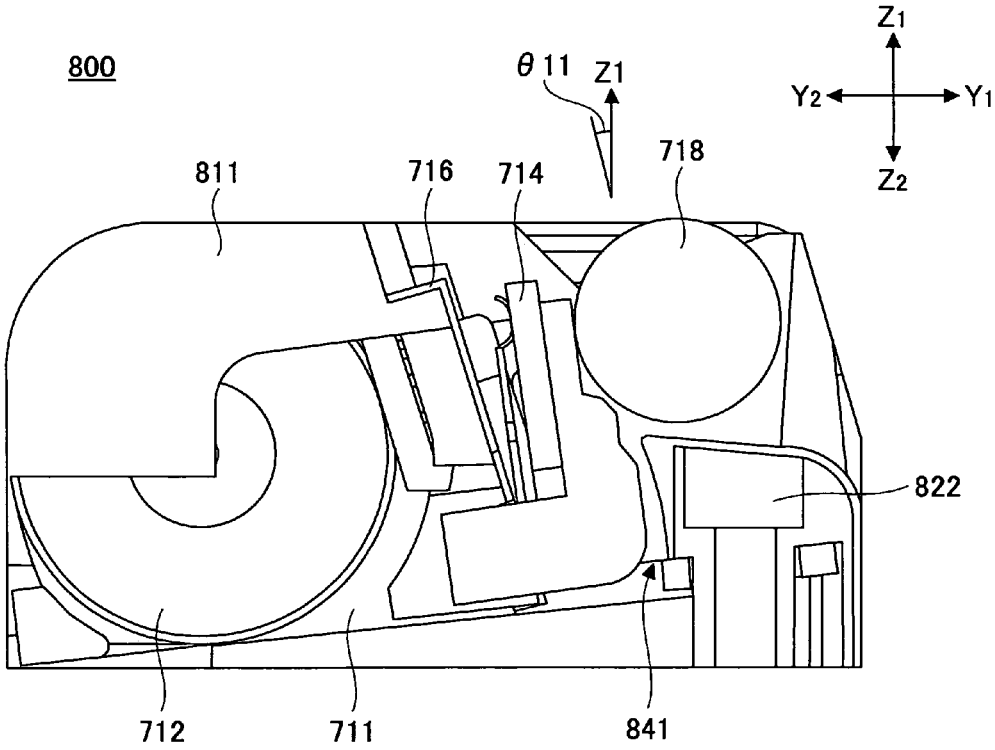
FIG. 46 shows a sectional view of the first variant embodiment of the seventh embodiment of the present invention.
Figure 47:
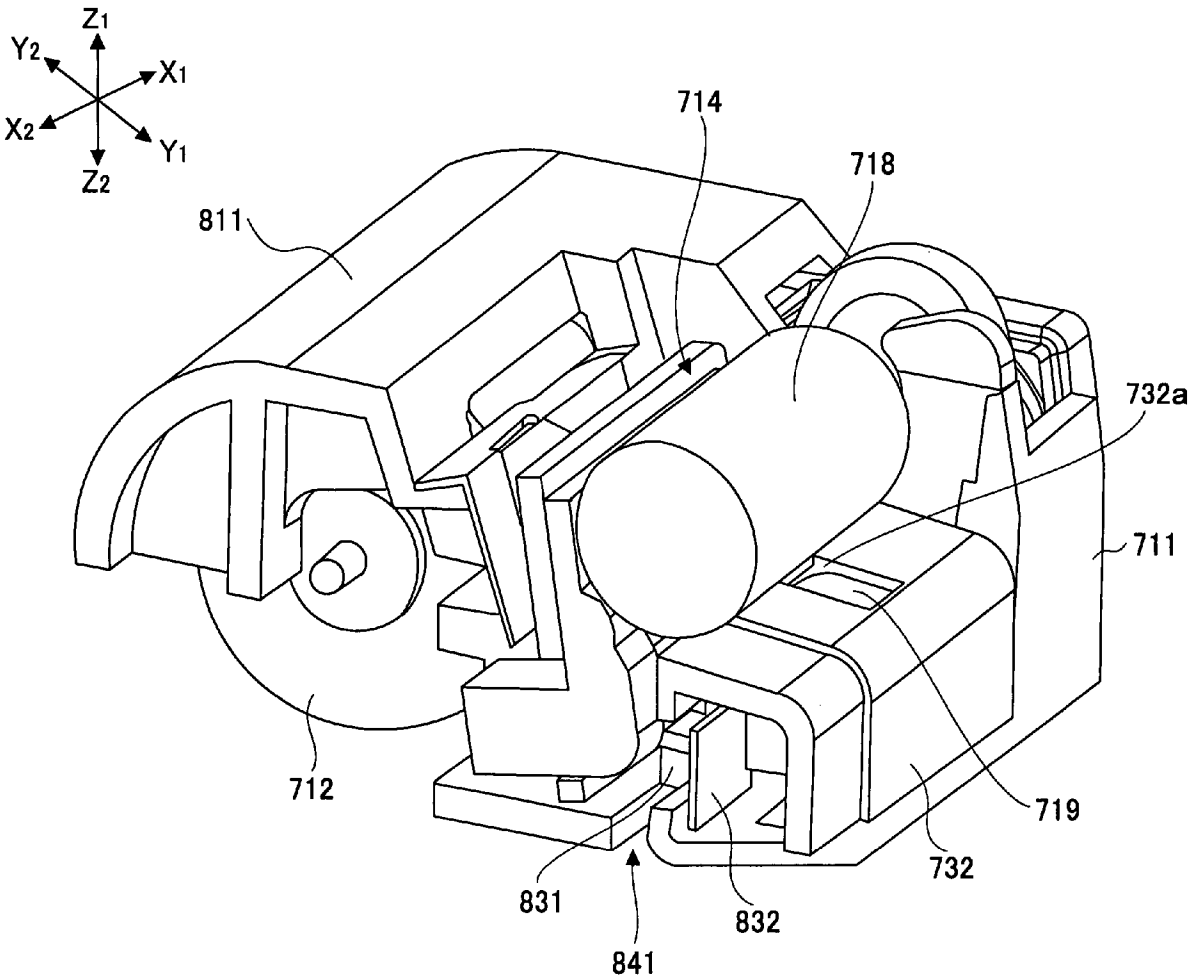
FIG. 47 shows a sectional perspective view of a relevant part of the first variant embodiment of the seventh embodiment of the present invention.

FIG. 42 shows a front perspective view of a first variant embodiment of the seventh embodiment; FIG. 43 shows a rear perspective view of the first variant embodiment of the seventh embodiment; FIG. 44 shows a bottom perspective view of the first variant embodiment of the seventh embodiment; FIG. 45 shows a plan view of the first variant embodiment of the seventh embodiment; FIG. 46 shows a sectional view of the first variant embodiment of the seventh embodiment; and FIG. 47 shows a sectional view of a relevant part of the first variant embodiment of the seventh embodiment. In these figures, the same reference numerals are given to the same components/parts as those in FIGS. 30 through 32, and duplicate description is omitted.

A printing apparatus 800 in this variant embodiment has a configuration such that, in the printing apparatus 700 in the seventh embodiment, the base frame 711 is common, the shape of the paper guide block 717 is changed, and a paper outputting direction is inclined by an angle θ11 with respect to the arrow Z1, Z2 directions. It is noted that, for the purpose that the paper outputting direction is thus inclined, the base frame 711 is disposed in an inclined manner accordingly.

Figure 48:
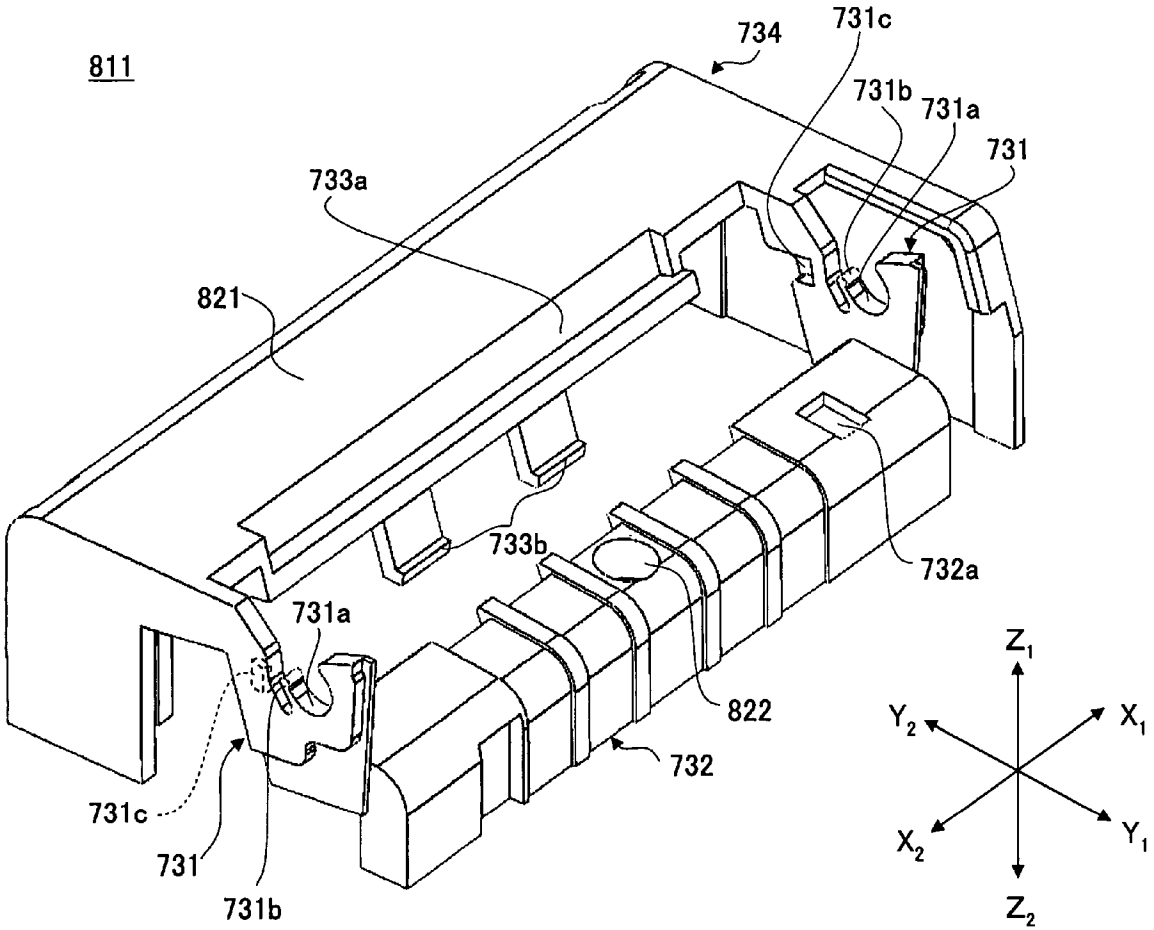
FIG. 48 shows a front perspective view of a paper guide block 811.
Figure 49:
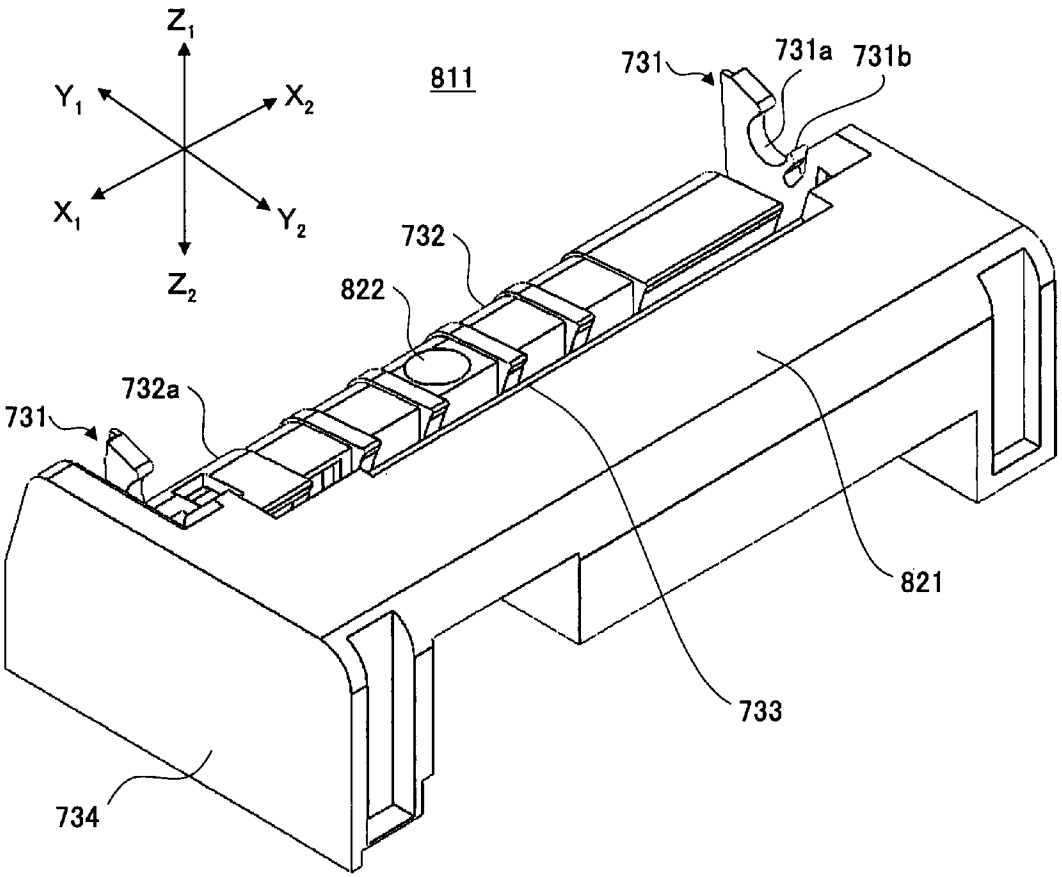
FIG. 49 shows a rear perspective view of the paper guide block 811.
Figure 50:
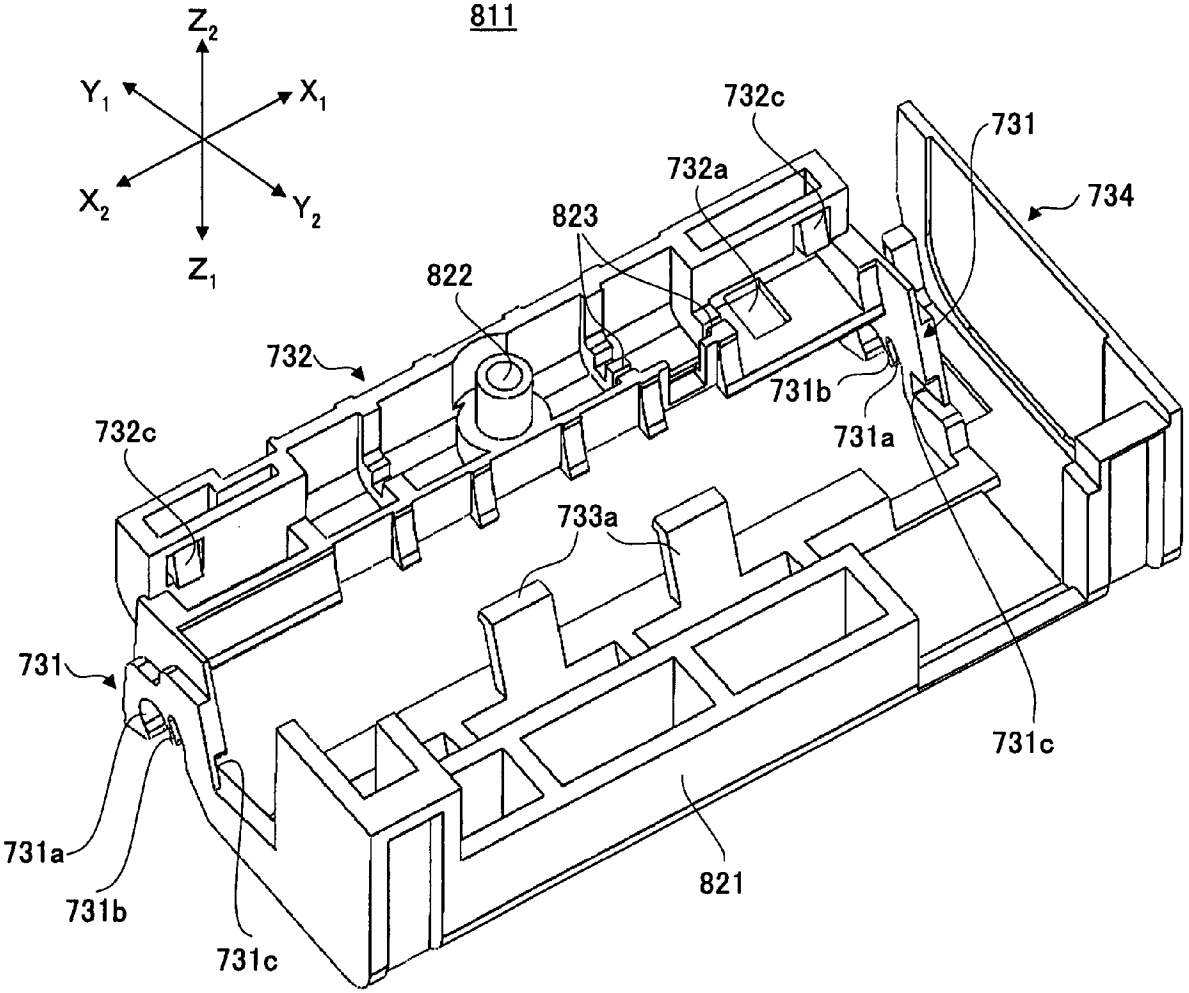
FIG. 50 shows a bottom perspective view of the paper guide block 811.

FIG. 48 shows a front perspective view of the paper guide block 811; FIG. 49 shows a rear perspective view of the paper guide block 811; and FIG. 50 shows a bottom perspective view of the paper guide block 811. In these figures, the same reference numerals are given to the same components/parts as those in FIGS. 38 through 40, and duplicate description is omitted.

In the paper guide block 811, the bearing parts 731 are disposed in such a manner as to be inclined by the angle θ11, and a cover part 821 is provided. The cover part 721 covers the surface of the apparatus on the arrow Z1, Y2 direction side. By means of providing the cover part 821, the apparatus can be handled as a separate miniaturized printing apparatus.

Further, in this variant embodiment, a mounting hole 822 is formed at a central part of the paper guide block 732. By screwing a screw into a to-be-mounted part through the mounting hole 822 of the paper guide block 811 and the mounting hole 724*a* of the base frame 711, the printing apparatus 800 is fixed to the to-be-mounted part. Thereby, it is possible to improve connectedness between the paper guide block 811 and the base frame 711.

Further, in this variant embodiment, a configuration is provided such that paper can be made to pass straightly. At this time, a sensor substrate mounting part 823 for mounting a sensor substrate for paper detection is formed on the paper guide part 732. On the sensor substrate mounting part 823, the sensor substrate 832 on which a sensor 831 is mounted is mounted. The sensor 831 faces in the arrow Y2 direction, and can detect the paper inserted in the arrow Z1 direction from a paper inserting hole 841.

In this variant embodiment, since, instead of the FPC cabled 715, a circuit substrate on which a connector, an interface circuit, a processing circuit and so forth are mounted is provided in such a manner as being accommodated in the cover part 821. Thus, the apparatus can be handled as the separate miniaturized printing apparatus.

Second Variant Embodiment

Figure 51:
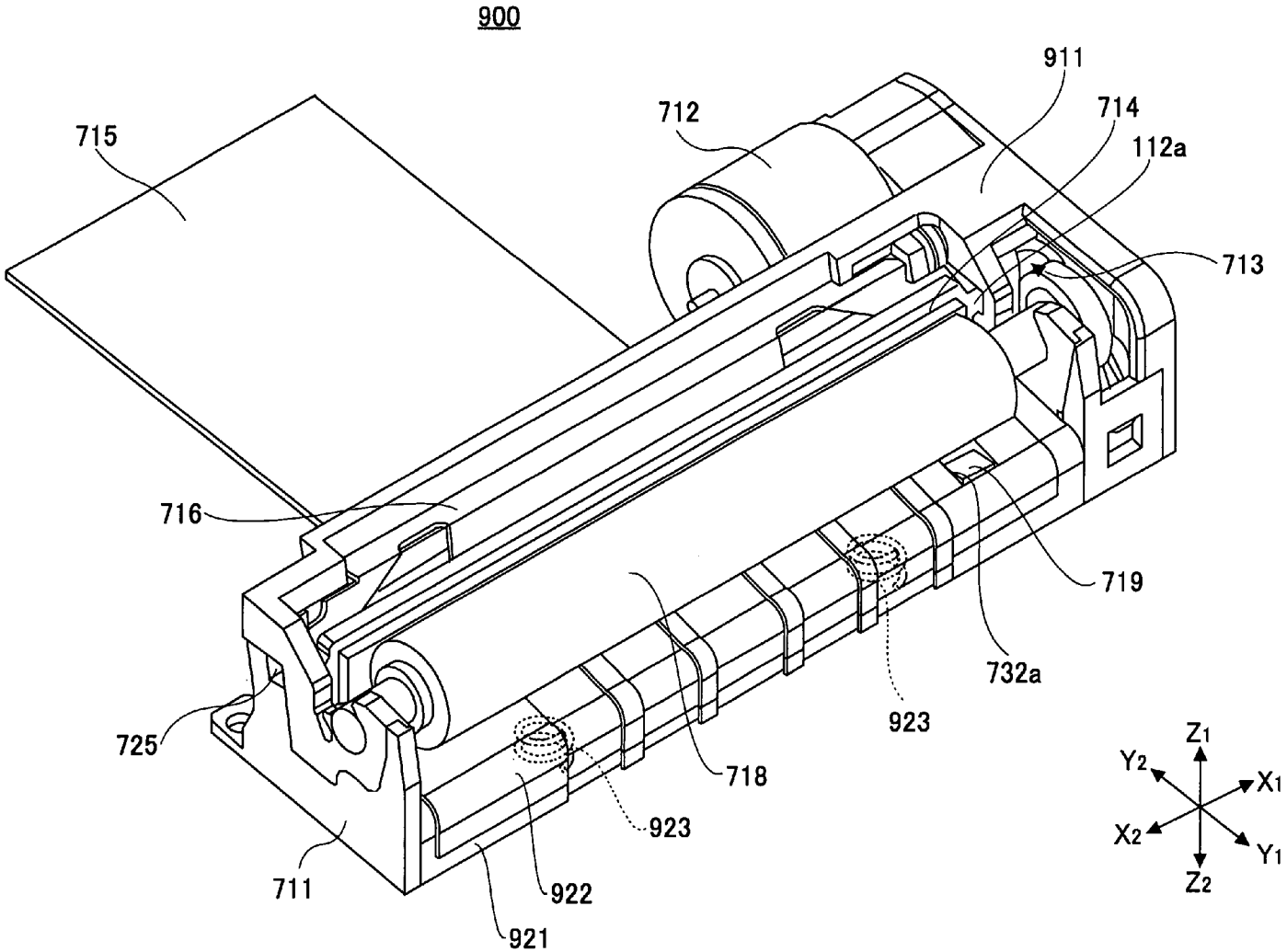
FIG. 51 shows a perspective view of a second variant embodiment of the seventh embodiment of the present invention.
Figure 52:
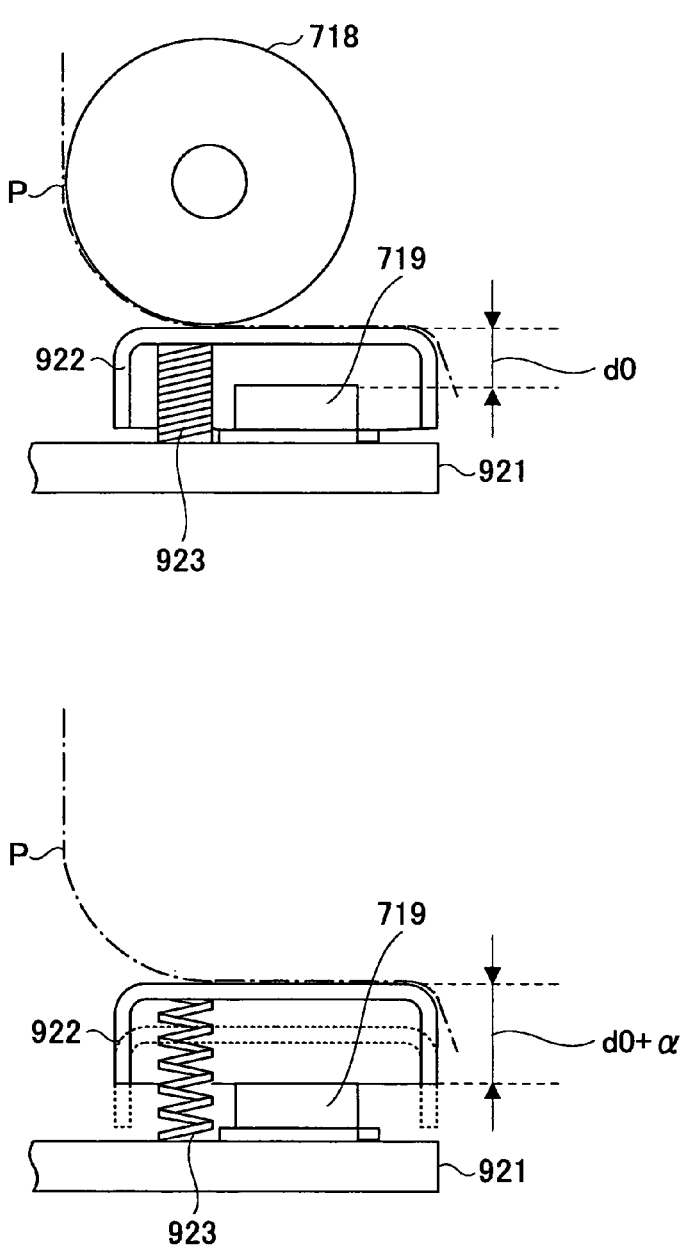
FIG. 52 shows a sectional view of a relevant part of the second variant embodiment of the seventh embodiment of the present invention.

FIG. 51 shows a perspective view of a second variant embodiment of the seventh embodiment; and FIG. 52 shows a sectional view of a relevant part of the second variant embodiment of the seventh embodiment. FIG. 52(A) shows a state in which a platen roller 718 is loaded; and FIG. 52(B) shows a state in which the platen roller 718 is removed. In the figures, the same reference numerals are given to the same components/parts as those in FIGS. 30 through 32, and duplicate description is omitted.

In a printing apparatus 900 in this variant embodiment, a configuration of a paper guide block 911 is different from that of the seventh embodiment. The paper guide block 911 of this variant embodiment includes a base part 921 and a movable paper guide part 922, and further, coil springs 923.

The base part 921 is integrally molded together with the paper guide block 911. On the base part 921, a sensor 719 is held. The movable paper guide part 922 is configured as a separate body from the paper guide block 911, and is coupled to the base part 921 through the coil springs 923.

In a state in which the platen roller 718 is loaded in the paper guide block 911, as shown in FIG. 52(A), the movable paper guide part 922 is held by the platen roller 718 in a state such that it is pressed in the arrow Z2 direction by the platen roller 718, and a distance of the surface of the movable paper guide part 922 from the sensor is d0. At this time, paper P is in a state such that it is held between the platen roller 718 and the movable guide part 922, and thus, a distance of the paper P from the sensor 719 is d0.

When the platen roller 718 is then removed from the paper guide block 911, the coil springs are released as shown in FIG. 52(B), and the movable paper guide part 922 is lifted in the arrow Z1 direction. Thereby, the distance of the surface of the movable paper guide part 922 from the sensor 719 becomes (d0+α). As a result of the movable paper guide part 922 being lifted in the arrow Z1 direction, the paper P is located at least at a position separate from the sensor 719 by (d0+α).

Accordingly, by detecting a change in the output of the sensor 719 for the distance, existence/absence of the platen roller 718 can be detected.

[Others]

It is noted that, in this variant embodiment, existence/absence of the platen roller 718 is detected from a change in the output of the sensor 719 according to the distance. However, existence/absence of paper P, a paper position mark M, and/or the platen roller 718 may be detected from difference in the reflectivity. It is noted that, the paper position mark M is a mark having a predetermined width printed on the paper P, and indicates position information such as a starting position or an end position of the paper P or such.

For example, the paper P is made of a white material, the paper position mark M is made of a black material, and the platen roller 718 is made of a gray material, for example. Then, when the paper P is located on the sensor 719, the output of the sensor 719 becomes high level since the paper P is white and the light reflectivity is high. Thus, when the output of the sensor 719 is high, it is determined that the paper P exists.

When the paper position mark M is located on the sensor 719, the output of the sensor 719 becomes low level since the paper position mark M is black and the light reflectivity is low. Further, the paper position mark M has the predetermined width, and before and after that is white. Thus, when the low output of the sensor 719 continues for a predetermined time period, it is determined that the paper position mark M exists.

When no paper P is located on the sensor 719, but the platen roller 718 is located there, the output of the sensor 719 becomes intermediate level between the high level and the low level, since the platen roller 718 is gray and the light reflectivity is intermediate between those of white and black. Thus, when the output of the sensor 719 is the intermediate level, it is determined that no paper P exists, but the platen roller is loaded.

Further, when the output of the sensor 719 continues to have the low level for more than the predetermined time period, it is determined that neither the paper P nor the platen roller 718 exists on the sensor 719.

Further, the present invention is not limited to the above-described embodiments, and variations and modifications may be made without departing from the basic concept of the present invention claimed below.

The present application is based on Japanese Priority Applications Nos. 2005-182502 and 2005-212737, filed on Jun. 22, 2005 and Jul. 22, 2005, respectively, the entire contents of which are hereby incorporated herein by reference.

What is claimed is:

1. A printing apparatus configured to carry out printing to paper with a printing head, while holding the paper between the printing head and a platen roller, comprising:

a paper guide block guiding the paper in between the printing head and the platen roller, and holding the platen roller; and a force applying member applying a force to the paper guide block in such a manner that the force applying member presses and moves the paper guide block with respect to the printing head, and as a result, the platen roller is pressed onto the printing head in a condition in which the paper is held between the platen roller and the printing head, the force applying member comprising a coil spring, wherein the paper guide block is in direct contact with the force applying member, and the paper guide block includes:

bearing parts that hold the platen roller, the bearing parts having cut out parts in a first direction, the first direction of the cut out parts being an upper direction; and a paper guide part located in a second direction reversed to the first direction, wherein:

the paper is placed on the paper guide part in a condition in which the platen roller is removed from the bearing parts, and, the platen roller is inserted into the bearing parts from the cut out parts, so that the paper is put between the platen roller and the paper guide part.

2. The printing apparatus as claimed in claim 1, wherein:

said paper guide block is held by a frame in a rotatable manner, and is pressed by said force applying member in a direction toward the printing head.

3. The printing apparatus as claimed in claim 2, wherein:

a sensor is provided for detecting existence/absence of the paper in the paper guide block, and/or existence/absence of the platen roller.

4. The printing apparatus as claimed in claim 3, wherein:

said frame comprises a through hole;

said sensor comprises any one of a photo-sensor and a photo-interrupter; and existence/absence of the paper or existence/absence of the platen roller is detected as a result of an intermediate level of an output signal of said sensor being detected.

5. The printing apparatus as claimed in claim 2, wherein:

said force applying member is inserted between the paper guide block and the frame, and presses the paper guide block in a direction toward the printing head.

6. The printing apparatus as claimed in claim 5, wherein:

said force applying member comprises a coil spring inserted between the paper guide block and the frame.

7. The printing apparatus as claimed in claim 5, wherein:
said force applying member comprises:
a contacting part electrically contacting the platen roller held by the paper guide block; and
a pressing part pressing the printing head in a direction toward the platen roller.

8. The printing apparatus as claimed in claim 5, wherein:
said force applying member comprises a rod spring made of a bent elastic wire.

9. The printing apparatus as claimed in claim 2, U-slots are provided in the frame and the paper guide block for engaging with a rotating shaft of the platen roller; and
said rotating shaft of the platen roller is rotatably held by the U-slots of the frame and the U-slot of the paper guide block.

10. The printing apparatus as claimed in claim 1, wherein:
said paper guide block is fixed to the frame; and
said force applying member is disposed between the printing head and the frame, and presses the printing head in a direction toward the guide block.

11. The printing apparatus as claimed in claim 10, wherein:
said force applying member comprises a rod spring made of a bent elastic wire.

12. The printing apparatus as claimed in claim 1, wherein:
the printing head and the paper guide block are fixed to a frame; and
said force applying member presses a rotating shaft of said platen roller in a direction toward the printing head.

13. The printing apparatus as claimed in claim 12, wherein:
said force applying member comprises a rod spring made of a bent elastic wire.

14. The printing apparatus as claimed in claim 1, wherein:
said paper guide block is fixed to the frame, and has a U-slot engaging with a rotating shaft of the platen roller; and
said force applying member comprises:
a pressing part inserted between the printing head and the frame, and pressing the printing head in a direction toward the platen roller; and
a claw part engaging with a rotating shaft of said platen roller when said rotating shaft of said platen roller engages with said U-slot of said paper guide block.

15. The printing apparatus as claimed in claim 1, wherein:
said paper guide block is integrally formed of resin.

16. The printing apparatus as claimed in claim 1, wherein:
said paper guide block comprises:
a paper guide part guiding the paper; and
a bearing part formed integrally with said paper guide part for rotatably supporting said rotating shaft of said platen roller, wherein:
said bearing part supports said bearing part with a mold spring.

17. The printing apparatus as claimed in claim 16, wherein:
said mold spring comprises:
a bearing rotatable supporting said rotating shaft of said platen roller; and
a slit part formed in a side part of said bearing.

18. The printing apparatus as claimed in claim 16, wherein:
said mold spring comprises:
a bearing rotatably supporting said rotating shaft of said platen roller; and
a groove part communicating with said bearing.

19. The printing apparatus as claimed in claim 1, wherein:
said paper guide block is fixed to the frame;
said printing head is rotatably supported by said paper guide block; and
said force applying member is provided between said frame and said printing head, and presses said printing head onto said platen roller.

20. The printing apparatus as claimed in claim 19, wherein:
said paper guide block has a head guide part rotatably supporting said printing head.

21. The printing apparatus as claimed in claim 20, wherein:
said frame comprises a retreating part communicating with said head guide part and allowing said printing head to retreat from said head guide part.

22. The printing apparatus as claimed in claim 19, wherein:
said paper guide block comprises an engaging part engages with said frame.

23. The printing apparatus as claimed in claim 19, wherein:
said paper guide block has a cover part integrally formed for covering a part of the apparatus.

24. The printing apparatus as claimed in claim 1, further comprising:
a paper guide part guiding said paper between said printing head and said platen roller.

25. The printing apparatus as claimed in claim 24, wherein:
said paper guide part comprises:
a curl passing guide part allowing said paper to pass in a curled manner; and
a straight passing guide part allowing said paper to straightly pass.

26. The printing apparatus as claimed in claim 24, wherein:
said paper guide block comprises an engaging part engages with said frame.

27. The printing apparatus as claimed in claim 26, wherein:
said paper guide block has a cover part integrally formed for covering a part of the apparatus.

28. The printing apparatus as claimed in claim 24, wherein:
said paper guide block has a cover part integrally formed for covering a part of the apparatus.

29. The printing apparatus as claimed in claim 1, wherein:
said paper guide block is fixed to a to-be-mounted part by means of said frame.

30. The printing apparatus as claimed in claim 29, wherein:
said paper guide block has a cover part integrally formed for covering a part of the apparatus.

31. The printing apparatus as claimed in claim 1, wherein:
an interface part for an interface with a host apparatus;
a processing part processing printing data provided via said interface part from said host apparatus; and
a driving part driving said printing head based on the printing data processed by said processing part, are integrally mounted together with said frame and said paper guide part.

* * * * *